US011619129B2

(12) United States Patent
Rowe

(10) Patent No.: US 11,619,129 B2
(45) Date of Patent: Apr. 4, 2023

(54) ESTIMATING FORMATION ISOTOPIC CONCENTRATION WITH PULSED POWER DRILLING

(71) Applicant: Halliburton Energy Services, Inc., Houston, TX (US)

(72) Inventor: Mathew Dennis Rowe, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 319 days.

(21) Appl. No.: 17/006,423

(22) Filed: Aug. 28, 2020

(65) Prior Publication Data

US 2022/0065105 A1 Mar. 3, 2022

(51) Int. Cl.

| | |
|---|---|
| ***E21B 7/15*** | (2006.01) |
| ***E21B 49/08*** | (2006.01) |
| ***E21B 49/00*** | (2006.01) |
| ***E21B 21/06*** | (2006.01) |
| *E21B 47/07* | (2012.01) |
| *E21B 47/06* | (2012.01) |

(52) U.S. Cl.

CPC ..... *E21B 49/08* (2013.01); *E21B 7/15* (2013.01); *E21B 21/067* (2013.01); *E21B 49/005* (2013.01); *E21B 47/06* (2013.01); *E21B 47/07* (2020.05)

(58) Field of Classification Search

CPC ..... E21B 7/14; E21B 7/15

See application file for complete search history.

(56) References Cited

U.S. PATENT DOCUMENTS

| | | | |
|---|---|---|---|
| 1,720,325 | A | 7/1929 | Hackstaff et al. |
| 2,328,555 | A | 9/1943 | Hoover, Jr. |
| 2,700,897 | A | 2/1955 | Arps |
| 4,536,713 | A | 8/1985 | Davis et al. |
| 4,741,405 | A | 5/1988 | Moeny et al. |
| 4,980,642 | A | 12/1990 | Rodney |
| 5,005,406 | A | 4/1991 | Jasinski et al. |
| 5,140,527 | A | 8/1992 | Jones et al. |
| 5,163,029 | A | 11/1992 | Bryant et al. |

(Continued)

FOREIGN PATENT DOCUMENTS

| | | | |
|---|---|---|---|
| CN | 102678044 | A | 9/2012 |
| CN | 202596572 | U | 12/2012 |

(Continued)

OTHER PUBLICATIONS

PCT Application No. PCT/US2021/028780, International Search Report, dated Aug. 4, 2021, 3 pages.

(Continued)

*Primary Examiner* — Giovanna Wright

(74) *Attorney, Agent, or Firm* — Delizio, Peacock, Lewin & Guerra

(57) ABSTRACT

Various apparatus or methods are arranged to determine a first isotope ratio of an effluent drilling fluid, wherein the effluent drilling fluid is a drilling fluid after the drilling fluid has interacted with a plasma discharge produced via one or more electrodes of a drill bit of a pulsed power drill string disposed in a borehole. A second isotope ratio is estimated based on the first isotope ratio and a downhole reaction generated by the plasma discharge.

18 Claims, 8 Drawing Sheets

(56) References Cited

U.S. PATENT DOCUMENTS

| | | | |
|---|---|---|---|
| 5,896,938 | A | 4/1999 | Moeny et al. |
| 6,026,099 | A | 2/2000 | Young |
| 6,104,022 | A | 8/2000 | Young et al. |
| 6,176,323 | B1 | 1/2001 | Weirich et al. |
| 6,761,416 | B2 | 7/2004 | Moeny |
| 7,124,030 | B2 | 10/2006 | Ellis |
| 7,174,254 | B2 | 2/2007 | Ellis |
| 7,337,660 | B2 | 3/2008 | Ibrahim et al. |
| 7,384,009 | B2 | 6/2008 | Moeny |
| 7,416,032 | B2 | 8/2008 | Moeny et al. |
| 7,527,108 | B2 | 5/2009 | Moeny |
| 7,529,626 | B1 | 5/2009 | Ellis |
| 7,530,406 | B2 | 5/2009 | Moeny et al. |
| 7,559,378 | B2 | 7/2009 | Moeny |
| 7,571,644 | B2 | 8/2009 | Ibrahim et al. |
| 7,959,094 | B2 | 6/2011 | Moeny |
| 8,083,008 | B2 | 12/2011 | Moeny |
| 8,172,006 | B2 | 5/2012 | Moeny |
| 8,186,454 | B2 | 5/2012 | Moeny |
| 8,567,522 | B2 | 10/2013 | Moeny |
| 8,575,541 | B1 | 11/2013 | Jamison et al. |
| 8,616,302 | B2 | 12/2013 | Moeny |
| 8,789,772 | B2 | 7/2014 | Moeny |
| 8,810,794 | B2 | 8/2014 | Breviere et al. |
| 9,010,458 | B2 | 4/2015 | Moeny |
| 9,016,359 | B2 | 4/2015 | Moeny |
| 9,190,190 | B1 | 11/2015 | Moeny |
| 9,328,594 | B2 | 5/2016 | Linetskiy |
| 9,335,438 | B2 | 5/2016 | Jamison et al. |
| 9,700,893 | B2 | 7/2017 | Moeny |
| 9,765,617 | B2 | 9/2017 | Gosney et al. |
| 10,001,465 | B2 | 6/2018 | Mitchell et al. |
| 10,113,364 | B2 | 10/2018 | Moeny et al. |
| 10,371,691 | B2 | 8/2019 | Strapoc et al. |
| 10,407,995 | B2 | 9/2019 | Moeny |
| 10,641,073 | B2 | 5/2020 | Curlett |
| 10,641,757 | B2 | 5/2020 | Rowe |
| 11,319,788 | B1 | 5/2022 | Shumway |
| 11,346,217 | B2 | 5/2022 | Rowe |
| 11,459,883 | B2 | 10/2022 | Rowe |
| 11,499,421 | B2 | 11/2022 | Rowe |
| 2005/0150688 | A1 | 7/2005 | MacGregor et al. |
| 2006/0037516 | A1 | 2/2006 | Moeny |
| 2007/0137893 | A1 | 6/2007 | Moeny et al. |
| 2007/0152494 | A1 | 7/2007 | Moeny |
| 2008/0147326 | A1 | 6/2008 | Ellis |
| 2008/0277508 | A1 | 11/2008 | Moeny |
| 2009/0126928 | A1 | 5/2009 | Sumrall et al. |
| 2010/0089577 | A1 | 4/2010 | Wideman et al. |
| 2010/0250142 | A1 | 9/2010 | Zamora et al. |
| 2010/0326651 | A1* | 12/2010 | Pietrobon ..... E21B 43/14 166/250.01 |
| 2011/0000713 | A1 | 1/2011 | Meeten et al. |
| 2011/0251795 | A1 | 10/2011 | Difoggio |
| 2012/0298421 | A1 | 11/2012 | Coates et al. |
| 2013/0032404 | A1 | 2/2013 | Donderici et al. |
| 2014/0008968 | A1 | 1/2014 | Moeny |
| 2014/0027178 | A1 | 1/2014 | Jeffryes et al. |
| 2015/0068806 | A1 | 3/2015 | Duran Toro et al. |
| 2015/0167440 | A1 | 6/2015 | Kasevich et al. |
| 2015/0260035 | A1 | 9/2015 | Rowe et al. |
| 2015/0268374 | A1 | 9/2015 | Rapoport |
| 2015/0308235 | A1 | 10/2015 | Moeny |
| 2015/0322326 | A1 | 11/2015 | Van Slyke et al. |
| 2015/0354352 | A1 | 12/2015 | Ezzat et al. |
| 2016/0010450 | A1 | 1/2016 | Donderici et al. |
| 2016/0115786 | A1 | 4/2016 | Breviere et al. |
| 2016/0153955 | A1* | 6/2016 | Strapoc ..... E21B 49/005 702/24 |
| 2017/0058608 | A1* | 3/2017 | Fraser ..... E21B 10/04 |
| 2017/0175505 | A1 | 6/2017 | Curlett |
| 2017/0226851 | A1 | 8/2017 | Hakami et al. |
| 2018/0148981 | A1 | 5/2018 | Moeny |
| 2019/0003298 | A1 | 1/2019 | Stolyarov et al. |
| 2019/0226336 | A1 | 7/2019 | Benson et al. |
| 2019/0368345 | A1 | 12/2019 | Rowe et al. |
| 2019/0376386 | A1 | 12/2019 | Wright et al. |
| 2020/0217143 | A1 | 7/2020 | Liu et al. |
| 2020/0224498 | A1 | 7/2020 | Liu et al. |
| 2021/0071489 | A1 | 3/2021 | Jamison et al. |
| 2022/0065044 | A1 | 3/2022 | Rowe |
| 2022/0065102 | A1 | 3/2022 | Rowe |
| 2022/0065103 | A1 | 3/2022 | Rowe |
| 2022/0065106 | A1 | 3/2022 | Rowe |
| 2022/0065107 | A1 | 3/2022 | Rowe |
| 2022/0065769 | A1 | 3/2022 | Rowe |

FOREIGN PATENT DOCUMENTS

| | | | |
|---|---|---|---|
| EP | 0700068 | A1 | 3/1996 |
| EP | 1508794 | A1 | 2/2005 |
| RU | 2477370 | C1 | 3/2013 |
| WO | 9806234 | A1 | 2/1998 |
| WO | 9937581 | A2 | 7/1999 |
| WO | 2006023998 | A2 | 3/2006 |
| WO | 2008097101 | A1 | 8/2008 |
| WO | 2013110328 | A1 | 8/2013 |
| WO | 2014100255 | A1 | 6/2014 |
| WO | 2015124733 | A2 | 8/2015 |
| WO | 2015154876 | A1 | 10/2015 |
| WO | 2017030614 | A1 | 2/2017 |
| WO | 2017146673 | A1 | 8/2017 |
| WO | 2018071020 | A1 | 4/2018 |
| WO | 2018136033 | A1 | 7/2018 |
| WO | 2018186828 | A1 | 10/2018 |
| WO | 2019245544 | A1 | 12/2019 |
| WO | 2019245545 | A1 | 12/2019 |

OTHER PUBLICATIONS

PCT Application No. PCT/US2021/028780, Written Opinion, dated Aug. 4, 2021, 3 pages.

PCT Application No. PCT/US2021/031572, International Search Report, dated Aug. 23, 2021, 5 pages.

PCT Application No. PCT/US2021/031572, Written Opinion, dated Aug. 23, 2021, 5 pages.

PCT Application No. PCT/US2021/070//6, International Search Report, dated Oct. 19, 2021, 5 pages.

PCT Application No. PCT/US2021/070776, Written Opinion, dated Oct. 19, 2021, 3 pages.

PCT Application No. PCT/US2021/070777, International Search Report, dated Oct. 18, 2021, 4 pages.

PCT Application No. PCT/US2021/070777, Written Opinion, dated Oct. 18, 2021, 6 pages.

PCT Application No. PCT/US2021/070815, International Search Report, dated Oct. 20, 2021, 3 pages.

PCT Application No. PCT/US2021/070815, Written Opinion, dated Oct. 20, 2021, 4 pages.

Bazargan, et al., "Wellbore Instability During Plasma Torch Drilling in Geothermal Reservoirs", 49th U.S. Rock Mechanics/Geomechanics Symposium, San Francisco, California, Jun. 28-Jul. 1, 2015, pp. 1-4.

Li, et al., "Influences on High-Voltage Electro Pulse Boring in Granite", Energies, Sep. 17, 2018, vol. 11, No. 9, pp. 1-17, ISSN 2461.

"Isotope Logging: Continuous isotopic ratio measurement service", [online] retrieved on Jun. 1, 2020 from https://www.slb.com/-/media/files/geoservices/product-sheet/isotope-logging-ps.ashx, 2015, 2 pages.

Behrends, et al., "Ultrasonic Relaxation and Fast Chemical Kinetics of Some Carbohydrate Aqueous Solutions", 1997 American Chemical Society, J. Am. Chem. Soc. vol. 119 No. 9, pp. 2182-2186.

Berner, et al., "Maturity Related Mixing Model for Methane, Ethane and Propane, based on Carbon Isotopes", Advances in Organic Geochemistry, vol. 13, No. 1-3, 1988, 6 pages.

Bruggeman, et al., "Non-Thermal Plasmas in and in Contact With Liquids", Journal of Physics D: Applied Physics 42, 2009, 28 pages.

Canonica, et al., "Quantitative Structure—Activity Relationships for Oxidation Reactions of Organic Chemicals in Water", Environmental Toxicology and Chemistry, vol. 22 No. 8, 2003, pp. 1743-1754.

(56) References Cited

OTHER PUBLICATIONS

Carrasquillo, et al., "Radical Reactivity in the Condensed Phase: Intermolecular Versus Intramolecular Reactions of Alkoxy Radicals", 2015 American Chemical Society, J. Phys. Chem. Lett. 6, pp. 2388-2392.
Chernyak, et al., "Plasma Catalysis of Chemical Reactions", Problems of Atomic Science and Technology, Series: Plasma Physics, 2014, pp. 124-129.
Cruse, et al., "Geochemistry of Low-Molecular Weight Hydrocarbons in Hydrothermal Fluids from Middle Valley, northern Juan de Fuca Ridge", Geochimica et Cosmochimica Acta, vol. 70, Issue 8, Apr. 15, 2006, 54 pages, https://doi.org/10.1016/j.gca.2006.01.015, 2006.
Donahue, et al., "New Rate Constants for Ten Oh Alkane Reactions From 300 to 400 K: An Assessment of Accuracy", 1998 American Chemical Society, J. Phys. Chem. vol. 102 No. 18, pp. 3121-3126.
Gierczak, et al., "Rate Coefficients for the Reactions of Hydroxyl Radicals With Methane and Deuterated Methanes", 1997 American Chemical Society, J. Phys. Chem. A vol. 101 No. 17, pp. 3126-3134.
Goddard, et al., "Novel Gas Isotope Interpretation Tools to Optimize Gas Shale Production", Report to Research Partnership to Secure Energy for America, 2013, 90 pages.
Hidenori, et al., "Streamer Discharges in Liquids and Their Applications", Institute of Electrical and Electronics Engineers Transactions on Dielectrics and Electrical Insulation vol. 7 No. 5, Oct. 2000, pp. 646-653.
Jiang, et al., "Review On Electrical Discharge Plasma Technology for Wastewater Remediation", Chemical Engineering Journal 236, 2014, pp. 348-368.
Kirkpatrick, et al., "Hydrogen, Oxygen, and Hydrogen Peroxide Formation in Aqueous Phase Pulsed Corona Electrical Discharge", 2005 American Chemical Society, Ind. Eng. Chem. Res. vol. 44 No. 12, pp. 4243-4248.
Kwok, et al., "Alkoxy Radial Isomerization in the Oh Radical-Initiated Reactions of C4-C8 N-Alkanes", 1996 American Chemical Society, J. Phys. Chem. vol. 100 No. 1, pp. 214-219.
Laroussi, "Low-Temperature Plasmas for Medicine?", Institute of Electrical and Electronics Engineers Transactions on Plasma Science vol. 37 No. 6, Jun. 2009, pp. 714-725.
Locke, et al., "Analysis and Review of Chemical Reactions and Transport Processes in Pulsed Electrical Discharge Plasma Formed Directly in Liquid Water", Plasma Chem Plasma Process, 2012, pp. 875-917.
Locke, et al., "Review of the Methods to Form Hydrogen Peroxide in Electrical Discharge Plasma With Liquid Water", Plasma Sources Science and Technology 20, 2011, pp. 1-15.
Malik, et al., "Water Purification by Electrical Discharges", Institute of Physics Publishing, Plasma Sources Science and Technology 10, 2001, pp. 82-91.
Medodovic, et al., "Primary Chemical Reactions in Pulsed Electrical Discharge Channels in Water", Journal of Physics D: Applied Physics 40, 2007, pp. 7734-7736.
Minakata, et al., "Development of a Group Contribution Method to Predict Aqueous Phase Hydroxl Radical (HO) Reaction Rate Constants", 2009 American Chemical Society, Environ. Sci. Technol. vol. 43 No. 16, pp. 6220-6227.
Minakata, et al., "Linear Free Energy Relationships Between Aqueous Phase Hydroxyl Radical Reaction Rate Constants and Free Energy of Activation", 2011 American Chemical Society, Environmental Science & Technology 45, pp. 3479-3486.
Nair, et al., "Mud Gas Isotope Logging using Mass Spectrometry", Society of Petroleum Engineers,2009 SPE Asia Pacific Oil and Gas Conference and Exhibition, Aug. 4-6, 2009, Jakarta, Indonesia, 13 pages.
Pironti, et al., "Determination of the 13C/12C Carbon Isotope Ratio in Carbonates and Bicarbonates by 13C NMR Spectroscopy", American Chemical Society, Analytical Chemistry 2017, 89, 21, 11413-11418, Sep. 13, 2017.
Pourzamani, et al., "Natural Organic Matter Degradation Using Combined Process of Ultrasonic and Hydrogen Peroxide Treatment", Geosciences Institute Yearbook UFRJ, vol. 38 No. 1, 2015, pp. 63-72.
Rao, et al., "Geochemical Assessment of Light Gaseous Hydrocarbons in Near-Surface soils of Kutch-Saurashtra: Implication for Hydrocarbons Prospects", Indian Academy of Sciences, J. Earth Syst. Sci. 122, No. 1, 2013, 9 pages.
Sahni, et al., "Quantification of Hydroxyl Radicals Produced in Aqueous Phase Pulsed Electrical Discharge Reactors", 2006 American Chemical Society, Ind. Eng. Chem. Res. vol. 45 No. 17, 2006, pp. 5819-5825.
Schoell, "Genetic Characterization of Natural Gases", The American Association of Petroleum Geologists Bulletin, V. 67, No. 12, 1983, 14 pages.
Shih, et al., "Chemical and Physical Characteristics of Pulsed Electrical Discharge Within Gas Bubbles in Aqueous Solutions", Plasma Chem Plasma Process, 2009, pp. 1-20.
Storey, et al., "Water Vapour, Sonoluminescence and Sonochemistry", Royal Society Publishing, Proc. R. Soc. Lond. A, 2000, pp. 1685-1709.
Sugiarto, et al., "Pulsed Plasma Processing of Organic Compounds in Aqueous Solution", Thin Solid Films 386, 2001, pp. 295-299.
Sugiarto, et al., "Transient Regime of Pulsed Breakdown in Low-Conductive Water Solutions", Institute of Physics Publishing, Journal of Physics D: Applied Physics 34, 2001, pp. 3400-3406.
Suhr, "Organic Syntheses Under Plasma Conditions", University of Tübingen, Germany, Department of Chemistry, pp. 395-414.
Suslick, et al., "Alkane Sonochemistry", 1983 American Chemical Society, J. Phys. Chem. vol. 87 No. 13, pp. 2299-2301.
Thagard, et al., "Plasma Chemistry in Pulsed Electrical Discharge in Liquid", Transaction of the Materials Research Society of Japan, 2009, pp. 257-262.
Zare, et al., "High-precision optical measurements of 13C/12C isotope ratios in organic compounds at natural abundance", Proceedings of the National Academy of Science of the United States of America, PNAS Jul. 7, 2009 106(27) 10928-10932; https://doi.org/10.1073/pnas.0904230106.
"U.S. Appl. No. 17/006,051, Non-Final Office Action", dated May 2, 2022, 10 pages.
"U.S. Appl. No. 17/006,247 Office Action", dated Mar. 17, 2022, 6 pages.
"U.S. Appl. No. 17/006,254 Office Action", dated Mar. 3, 2022, 8 pages.
"U.S. Appl. No. 17/005,848 Office Action", dated Oct. 28, 2022, 26 pages.
"U.S. Appl. No. 17/006,396 Non Final Office Action", dated Aug. 25, 2022, 6 pages.

* cited by examiner

ESTIMATING FORMATION ISOTOPIC CONCENTRATION WITH PULSED POWER DRILLING

BACKGROUND

The disclosure generally relates to logging of drilling fluid while performing pulsed power drilling. More specifically, but not by way of limitation, this disclosure relates to analyzing isotopic composition of a fluid from a borehole while performing pulsed power drilling.

Electrocrushing or pulsed power drilling uses pulsed power technology to form a borehole in a rock formation. Pulsed power technology repeatedly applies a high electric potential across the electrodes of a pulsed-power drill bit to produce an electric or plasma discharge, which ultimately causes the surrounding rock to fracture. The fractured rock is carried away from the bit by drilling fluid, i.e., drilling mud, and the bit advances downhole.

While the borehole is being drilled, various measurements can be obtained from fluid returns from the drilling fluid. For example, these measurements may provide a running log or record of the drilling operation, which permits a well operator to analyze one or more earth formations that are progressively being penetrated by the drill bit.

The process of performing pulsed power drilling can affect the chemical composition of downhole fluid, including the drilling fluid and any formation fluid that has flowed into the drilling fluid.

BRIEF DESCRIPTION OF THE DRAWINGS

Aspects of the disclosure may be better understood by referencing the accompanying drawings.

DESCRIPTION

Figure 1:
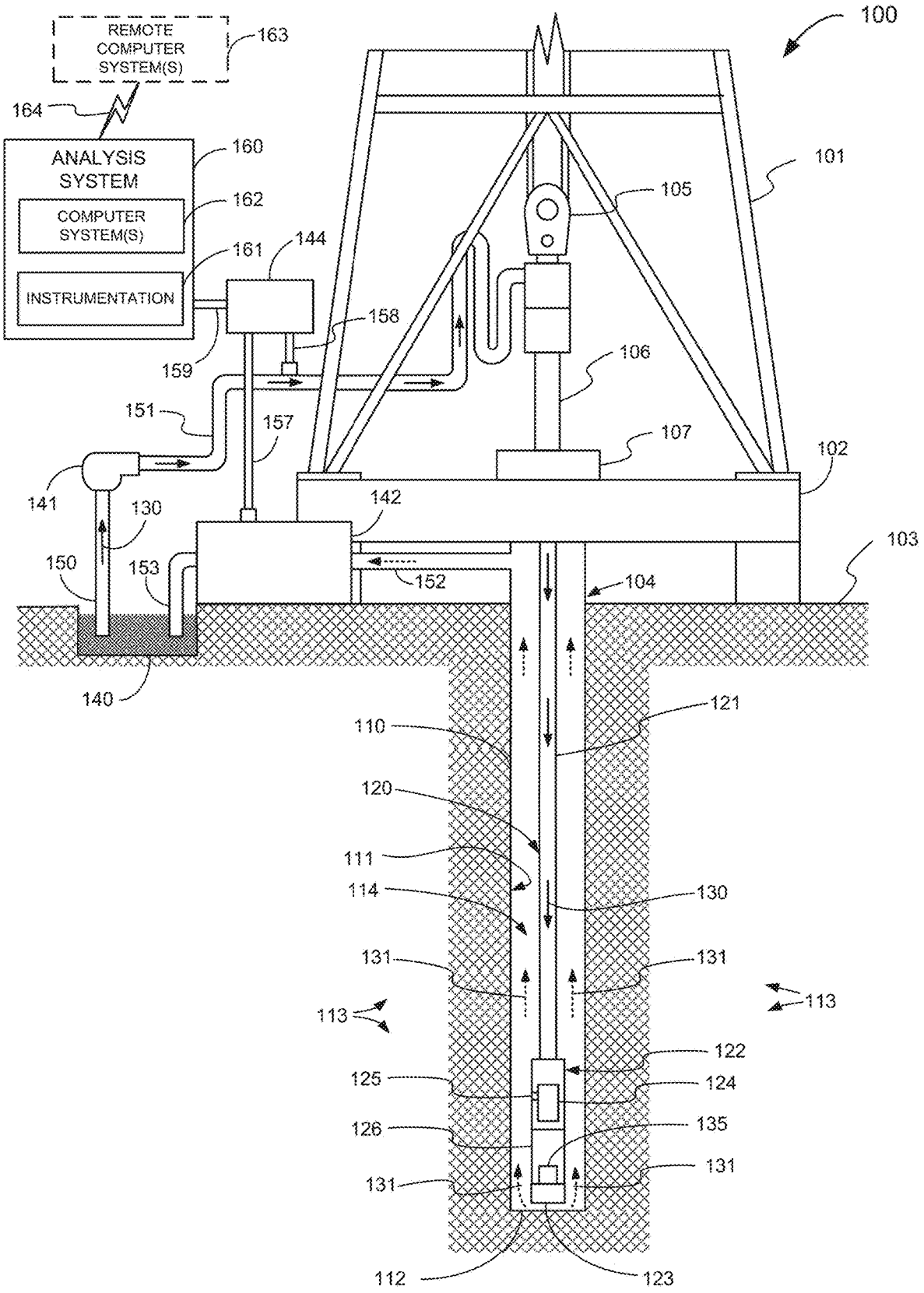
FIG. 1 illustrates a schematic diagram of a pulsed power drilling system, according to one or more embodiment.

The description that follows includes example systems, methods, techniques, and program flows that embody one or more embodiment of the disclosure. However, it is understood that this disclosure may be practiced without these specific details. For instance, this disclosure refers to pulsed direct current (DC) plasma in illustrative examples. Aspects of this disclosure can be also applied to sustained or alternating current (AC) plasmas. Additionally, while analysis may be described in reference to being performed at the surface of a borehole, example embodiments can include at least a partial analysis downhole. For example, some or all of the analysis can be performed in a downhole tool. In other instances, well-known instruction instances, protocols, structures, and techniques have not been shown in detail in order not to obfuscate the description.

When performing mud logging during drilling using a pulsed power drilling system it is useful to determine an isotopic concentration, e.g., of carbon, oxygen, or other downhole isotopes, of the formation fluid. This isotopic concentration can be expressed as an isotope ratio. For example, for carbon the isotope ratio can be expressed by Equation 1:

$$\delta^{13}C(0/00) = \left[\frac{R_S - R_{VPDB}}{R_{VPDB}}\right] \times 1000 \tag{1}$$

where $R_S$ is the $C^{13}/C^{12}$ ratio of a sample and $R_{VPDB}$ is the $C^{13}/C^{12}$ ratio of the Vienna PDB ($V_{PDB}$) standard. Knowing the isotopic ratio $\delta^{13}C$ at every depth (or at least almost every depth), gives insight into a subsurface reservoir system in which the borehole is located, e.g., giving insight into whether the reservoir is thermogenic (producing more oil) or biogenic (producing more gas) and whether there has been degradation of formation fluids. This insight can be derived because $C^{12}/C^{12}$ bonds are preferentially destroyed during degradation because they are weaker. Enrichment $C^{13}$ of results because $C^{12}$ hydrogen bonds degrade faster. The isotopic ratio can thus aid in the determination of whether the formation fluid is water, oil, or gas. The isotope ratio can also give insight into the history of the reservoir, e.g. telling the kind of source material, the age of the reservoir, and how organic substances in the reservoir changed over time. For example, the isotope ratio can help determine whether there have been one or more charges to the reservoir, how the reservoir moved, and if the reservoir is connected to another reservoir. This insight can be used as a source for formation modeling, such as updating a static earth model of the reservoir system.

During pulsed power drilling, the plasma energy output from electrodes on the drill bit create downhole chemical reactions between the species downhole. These chemical reactions can generate chemically complex molecules which should be accounted for in mud logging because these complex molecules are not constituents of either the formation fluid or the drilling fluid. The isotopic concentration, e.g. for carbon isotopes, will change due to the reaction selectivity of plasma based drilling apparatuses chemical reactions. For example, a difference in bond energy of $C^{12}$ and $C^{13}$ leads to a shift in chemical reactions related to plasma spark generation. By correlating the concentration of chemical species returned to the surface to plasma generation parameters, formation evaluation and mud logging can be more accurate. Specifically, the isotope ratio of the formation for each depth can be estimated or determined from measuring drilling fluid that has interacted with the plasma, e.g., by measuring the drilling fluid at the surface and/or with a downhole sampling tool.

FIG. 1 illustrates a schematic diagram of a pulsed power drilling system (system 100), according to one or more embodiment. System 100 as illustrated in FIG. 1 includes a derrick 101 positioned on a platform 102 that is located above surface 103 and covering a wellhead 104. Wellhead 104 includes a wellbore or borehole 110 that extends from surface 103 into one or more layers of subsurface formation 113. The borehole 110 may include borehole walls 111 that extend substantially vertically (e.g., within 10% from vertical) from surface 103 and parallel to one another, forming, and at least partially enclosing, the space within the borehole 110 that extends from surface 103 to a borehole bottom surface 112. Although shown as having substantially a vertical orientation in FIG. 1, embodiments of borehole 110 are not limited to vertically orientated boreholes, and may include at least some portion(s) of the borehole 110 that extend at an angle relative to vertical, including in some embodiments portions of the borehole 110 that may extend horizontally in a direction parallel to surface 103.

System 100 includes a drill string 120 that may be positioned over and extending downward into borehole 110. Drill string 120 may be supported at an upper portion by a hoist 105 suspended from derrick 101 that allows drill string 120 to be controllable lowered into and raised to different depths within borehole 110, and/or inserted into and completely withdrawn from the borehole 110. Drill string 120 may be coupled to hoist 105 through a kelly 106 and may extend through rotary table 107 positioned adjacent to and/or extending through an opening in platform 102. Rotary table 107 may be configured to maintain the position of the drill string 120 relative to platform 102 as the drill string 120 is extended through the opening in the platform 102 and into borehole 110. Drill string 120 may comprise a plurality of sections of drill pipe 121 coupling a lower or distal end of the drill string 120 to a bottom hole assembly (BHA) 122. The BHA 122 includes a pulsed power drilling (PPD) assembly 126 having a drill bit 123 and a pulse-generating circuit 135.

A drilling fluid 130, often called drilling "mud," may be initially sourced from a fluid pit 140, which may be referred to as a "mud pit." Although depicted below the surface 103, the fluid pit 140 can be equipment located on the surface 103 as well. A pump 141 may be used to suction the drilling fluid 130 from fluid pit 140 through fluid conduit 150, and provide a pressurized flow or circulation of the drilling fluid through fluid conduit 151 to the upper portion of drill string 120, as illustratively represented by the solid line arrows included within fluid conduits 150 and 151. The drilling fluid 130 may then proceed through the sections of drill pipe 121 that make up portions of drill string 120, providing a fluid passageway for the drilling fluid 130 to flow from the upper portion of drill string 120 to the BHA 122 positioned within the drill string 120.

The flow of drilling fluid 130 is directed through the BHA 122 and expelled from one or more ports included in the drill bit 123. The drilling fluid 131, as illustratively represented in FIG. 1 by dashed-line arrows, that has been expelled from ports on, or through, drill bit 123 helps to remove formation material that has been broken up by the electrical energy generated at the drill bit 123 in a direction away from drill bit 123 and away from borehole bottom surface 112.

In addition to carrying away broken up formation material, the flow of drilling fluid 131 may also represent drilling fluid that has been exposed to or that has otherwise interacted with the electrical energy, i.e. the plasma, being applied by drill bit 123 to the borehole bottom surface 112 and/or to the drilling fluid in the vicinity of drill bit 123. Drilling fluid 131 is illustrated as dashed-line arrows to represent drilling fluid that may have one or more chemical properties and/or one or more physical properties of the drilling fluid that have been altered due to the interaction of the drilling fluid with the electric energy provided by drill bit 123. The flow of drilling fluid 131 continues to flow back upward toward surface 103 through annulus 114 of borehole 110. An annulus 114 is formed by the space between the borehole walls 111 and the outer surfaces of the drill string 120. The drilling fluid 130 flowing into the drill string from the mud pit before the drilling fluid has based the drill bit 123 can be referred to as "influent," and the drilling fluid 131 flowing from the drill bit 123 back the fluid pit 140 can be referred to as the "effluent." In one or more embodiment, this drilling fluid 130, the influent or inward flow, and the drilling fluid 131, the effluent or upward/outward flow, are part of a continuous circulation of drilling fluid. As a plasma discharge occurs at the drill bit 123 (which will be discussed in detail below), the influent drilling fluid 130 can also be defined as the drilling fluid before the drilling fluid has interacted with the plasma discharge. Likewise, the effluent drilling fluid 131 can be also be defined as the drilling fluid after the drilling fluid has interacted with the plasma discharge.

As the upward flow of effluent drilling fluid 131 reaches surface 103, the flow may be directed into fluid conduit 152, which directs the flow of effluent drilling fluid 131 to fluid reconditioning system 142. Fluid recondition system 142 may comprise any number of devices, such as shakers, screens, and/or wash stations, which are configured to process the drilling fluid, for example to remove and/or recover cuttings from the effluent drilling fluid 131 being processed. In one or more embodiment, fluid reconditioning system 142 can include one or more of desalters, desanders, and de-gassing apparatus. Fluid reconditioning system 142 may also process the drilling fluid to refine or alter other properties of the drilling fluid, for example to remove dissolved or suspended gasses present in the drilling fluid. Fluid reconditioning system 142 may also be configured to add chemicals to the drilling fluid to alter or reinforce various performance properties of the drilling fluid before the drilling fluid is ultimately returned/recirculated to the borehole 110. Upon completion of the processing of the drilling fluid passing through fluid reconditioning system 142, the drilling fluid may be returned to fluid pit 140 through fluid conduit 153. The drilling fluid returned to fluid pit 140 may then become available for recirculation to borehole 110 as described above.

An extraction system 144 is fluidly coupled to the circulation of drilling fluid via fluid conduit 157 running from the fluid reconditioning system 142 to extract an effluent sample of effluent drilling fluid 131 that has exited the borehole 110 via fluid conduit 152. The extraction system 144 is optionally also coupled to fluid conduit 151 via fluid conduit 158 to extract an influent sample of the influent drilling fluid 130 prior to its entering into the drill string 120.

In one or more embodiment, the extraction system 144 includes one or more gas extractors to extract or sample a gas sample from the effluent drilling fluid 131, one or more sampling apparatus to sample or extract the liquids portion of the fluid, or both. To obtain one or more samples of the effluent drilling fluid 131, the extraction system 144 can sample gas or liquids directly from the fluid reconditioning system 142 or, although not shown, from another point in the flow of effluent drilling fluid 131 from the borehole 110 or the flow of influent drilling fluid 130 into the drill string. At the very least, the effluent samples can be taken from the effluent drilling fluid 131 after the drilling fluid has interacted with the plasma discharge and/or reaction products resulting therefrom.

In addition to the effluent drilling fluid 131 being directed to fluid reconditioning system 142 as described above, in various embodiments of system 100, a portion of the returning drilling fluid is directed to a sample analysis system (analysis system 160). The extraction system 144 directs drilling fluid (e.g., effluent drilling fluid 131) extracted or sampled from the fluid recondition system 142 to the analysis system via fluid conduit 159. In one or more embodiment, the extraction system 144 extracts or samples the influent drilling fluid 130, e.g., from fluid conduit 151 as shown or, although not shown, from one or more other points in the influent side of the system, e.g., from fluid conduit 150 or from the fluid pit 140, to obtain one or more samples of the influent drilling fluid.

Analysis system 160 may include instrumentation 161 and one or more computer systems (hereafter computer system(s) 162). Instrumentation 161 may comprise one or more devices configured to measure and/or analyze one or more chemical and/or physical properties of the drilling fluid provided to the analysis system 160. Illustrative and non-limiting examples of the devices that may be included as part of instrumentation 161 include one or more gas chromatograph (GC) (e.g., one or more of a gas chromatography-isotope ratio mass spectrometer (GC-IRMS), gas chromatography-infrared isotope ratio analyzer (GC-IR2), dual gas chromatograph with a flame ionization detector (FID), or the like) and one or more mass spectrometer (e.g., one or more of a isotope ratio mass spectrometer (IRMS), magnetic sector mass spectrometer, Time-of-Flight mass spectrometer (TOF-MS), triple quadrupole mass spectrometer (TQMS), tandem mass spectrometer (MS/MS), thermal ionization-mass spectrometer (TIMS), inductively coupled plasma-mass spectrometer (ICP-MS), Spark Source mass spectrometer (SSMS), or the like). In one or more embodiment, instrumentation 161 can further include one or more of a liquid chromatograph, a laser spectrometer, a multivariate optical computing device (e.g., one or more integrated optical element), a nuclear magnetic resonance (NMR) measurement device, a cavity ring-down spectrometer, an electromechanical gas detector, a catalytic gas detector, an infrared gas detector, a cutting analysis tool or system for further analysis of the gas, liquid, and/or solids. In one or more embodiment, instrumentation 161 also can include one or more temperature sensors for measuring the temperature of the effluent and/or influent samples and can include one or more pressure sensors to measure the pressure of the effluent and/or influent samples. These sensors or others sensors can also be distributed at different points along the fluid circulation path, such as in the extraction system 144, the pump 141, the BHA 122, the drill string, the annulus 114, along any of the fluid conduits 150-159, and/or at another point int the fluid circulation path.

Instrumentation 161 may provide one or more measurements or determined outputs to computer system(s) 162 that can be used as inputs for further analysis, learning, calculation, determination, display, or the like. The one or more inputs to computer system(s) 162 can include isotopic concentration (e.g., isotope amounts, ratios, and types), chemical composition (e.g., identity and concentration in total or of individual components or compounds), phase presence (e.g., gas, oil, water, etc.), impurity content, pH, alkalinity, viscosity, density, ionic strength, total dissolved solids, salt content (e.g., salinity), porosity, opacity, bacteria content, total hardness, combinations thereof, state of matter (solid, liquid, gas, emulsion, mixtures, etc.), and the like. The chemical composition can, for example, include the hydrocarbon composition, e.g., alkanes (C1 to C40), alkenes, naphthenes (cyclic alkanes where the carbon chain loops back on itself), isomers, inorganics, or the like. The isotopic concentration may include the amount and/or ratio one or more types of isotopes, e.g., carbon, hydrogen, oxygen, or the like.

The fluid samples received by, or continuous measurements obtained by, analysis system 160, e.g., as inputs to computer system(s) 162, may be correlated with time, depth, and/or other information related to the interaction of the fluid sample with electrical energy emanating from the drill bit 123. For example, a sample of drilling fluid may be correlated to a specific time and/or a depth where drilling fluid sample was when the fluid interacted with electrical energy emanating from drill bit 123. In one or more embodiment, this correlation is based, at least in part, on the measured rates for flow of the drilling fluid down through the drill string 120 and back up through annulus 114 over time to determine when the sample of drilling fluid being analyzed interacted with the electrical energy provided by drill bit 123.

Computer system(s) 162, in one or more embodiment, are integral with one or more of the devices including the instrumentation 161, and/or may be separate computer device(s) that may be communicatively coupled to the devices included in instrumentation 161. In other examples, computer system(s) 162 may be computing devices, such as personal computers, laptop computers, smart phones, or other devices that allow a user, such as a field technician or an engineer, to enter, observe, and otherwise interact with various software applications providing data reports and control inputs for the measurements and analysis being performed on the drilling fluid by analysis system 160.

In various embodiments, although not shown, computer system(s) 162 may be communicatively linked with other devices, such as BHA 122, pump 141, extraction system 144, and/or fluid reconditioning system 142, i.e. collectively a fluid system. The communication provided between computer system(s) 162 and other device within system 100 may be configured to allow computer system(s) 162 to adjust operating parameters, such as but not limited to adjusting the flow rates of drilling fluid provided to drill string 120, control over the positioning of drill string 120 with the borehole, and control over the operating parameters associated with the electrical generation and application of electrical power being performed by BHA 122. Communications from computer system(s) 162 may also be used to gather information provided by fluid reconditioning system 142, and/or to provide feedback to fluid reconditioning system 142 to control the processes being performed on the returning drilling fluid by the fluid reconditioning system 142.

The analysis system 160 can analyze extracted samples (e.g., via extraction system 144) from influent drilling fluid 130 and from effluent drilling fluid 131, can output one more composition of the drilling fluid, one or more composition of the formation fluid, and/or one or more isotope ratio. For example, the extracted sample from the influent drilling fluid 130 can be used a baseline to determine the contribution of the formation fluid and/or a downhole reaction at the drill bit 123 to the composition of the effluent drilling fluid 131.

The analysis system 160 may determine various parameters related to the formation 113, and/or various parameters related to the operation of the pulsed power drilling assembly, based on measurements and/or analysis performed to determine various chemical and/or physical properties present in the drilling fluid that has been exposed to or that has otherwise interacted/reacted with the electrical energy provided by drill bit 123. Further, various operating parameters, such as electrical parameters, associated with the discharge of the electrical energy from drill bit 123 within borehole 110, may be measured and analyzed to derive data and make determinations about various parameters associated with the formation 113, parameters associated with properties of the drilling fluid, parameters associated with the operating parameters of the BHA 122, and/or parameters associated with the operating parameters of the PPD assembly 126.

In various embodiments, system 100 may include analysis system 160 having a communication link 164, illustratively represented by a "lightning bolt," configured to provide communications between analysis system 160 and one or more remote computer systems 163. Remote computer systems 163 may be configured to provide any of the data functions associated with and/or the analysis function described above that may be associated with the drilling fluid as provided by analysis system 160. In various embodiments, remote computer systems 163 may including storage devices, such as data storage disks, configured to store the data being generated by the analysis being performed by analysis system 160. In various embodiments, remote computer system 163 may include display devices, such as computer monitors, that allow users at a remote location, i.e., locations away from the location where system 100 is physically located, to visually see and interact with the visual representations of the data being provided by analysis system 160. In various examples, control inputs, as described above, may be provided via user input provided to the remote computer systems 163 and communicated to analysis system 160 for the purpose of controlling one or more of the operating parameters associated with system 100.

In one or more embodiments, BHA 122 includes a sampling tool 124. Sampling tool 124 may be located within the housing of BHA 122. Sampling tool 124 may be coupled to annulus 114 through at least one port 125, wherein port 125 provides a fluid communication passageway between annulus 114 and sampling tool 124. In various embodiments, port 125 may be used to collect a sample of drilling fluid, such as the effluent drilling fluid 131. The sample of collected drilling fluid may be provided to analysis system 160, where one or more measurements and/or further analysis of the drilling fluid may be performed by the sampling tool. Measurements made, e.g., from one or more pressure or temperature sensors and/or a multivariate optical computing device, and/or data collected from the analysis of the samples of drilling fluid collected through port 125 may be communicated through a communication link, e.g., via wired (like a wireline or wired pipe) or wireless telemetry (like mud pulse, acoustic, or electromagnetic telemetry) to the surface, and optionally to analysis system 160. In the alternative or in parallel with the above, the sample of drilling fluid collected through port 125 may be contained, for example bottled, and then transported back to the surface with the BHA 122. Any samples of drilling fluid collected via port 125 may be data stamped with information indicating the time, depth, and/or other information associated with the collection of the fluid sample.

Figure 2:
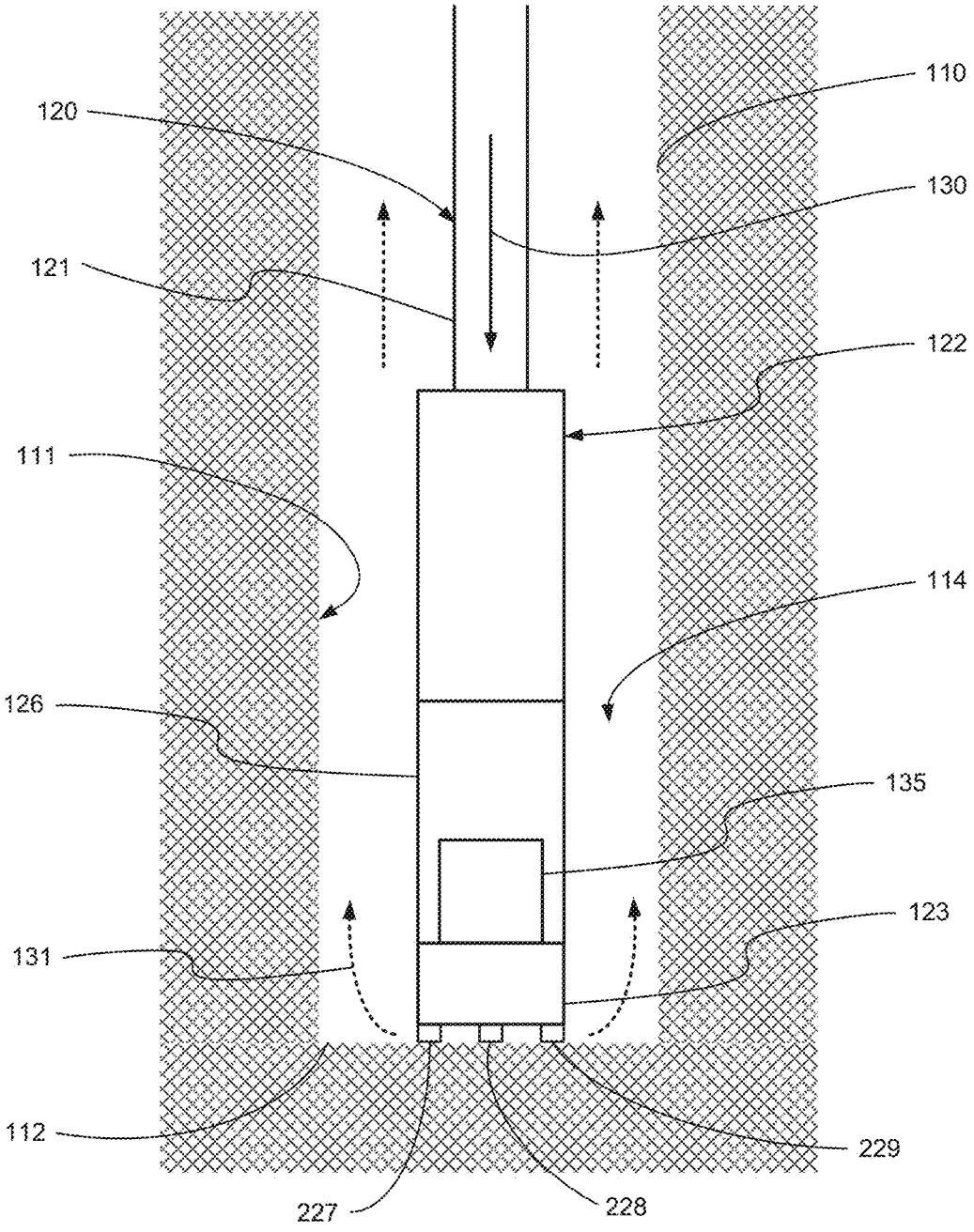
FIG. 2 illustrates a schematic diagram of an enlarged portion of the pulsed power drilling system, according to one or more embodiment.

FIG. 2 illustrates a schematic diagram of an enlarged portion of system 100, according to one or more embodiment. As depicted in FIG. 2, drill bit 123 has one or more electrodes (three electrodes 227-229 are shown) disposed on a surface of the drill bit 123 that faces the borehole bottom surface 112. In one or more embodiment, the drill bit 123 can have at least one central electrode 228 and at least one outer electrode, e.g., a first outer electrode 227 and a second outer electrode 229. While three electrodes are depicted, many more electrodes can be used. Further, the electrodes can be arranged differently on and around the drill bit 123. For example, multiple outer electrodes may be spaced azimuthally around the drill bit 123. In yet another configuration, at least one central electrode 228 can include multiple central electrodes, for example azimuthally distributed around a central point and radially closer to the central point than at least one of the outer electrodes. Although not show, in at least one embodiment, one or more ground ring can be disposed proximate to or touching the circumference of the bottom of the drill bit 123, for example replacing, or disposed proximate to but not touching, the one or more outer electrodes. At least one of the electrodes can act as an anode and another as a cathode. For example, in one or more configurations and/or one or more operating modes, the central electrode 228 can operate as an anode and at least one of the first and second outer electrodes 227, 229 can operate as a cathode. In one or more other configurations and/or one or more other operating modes, the first outer electrode 227 can operate as an anode and at least one of the central electrodes 228 and the second outer electrode 229 can operate as a cathode.

The PPD assembly 126 can be configured to supply power to the drill bit 123 and ultimately to at least one of the one or more electrodes 227-229 via pulse-generating circuit 135. In one or more embodiment, power is supplied to the PPD assembly 126 from the surface, via one or more wires or via wired pipe. In other embodiments, the PPD assembly 126 is configured to generate electrical energy produced from a mechanical flow of drilling fluid provided to the bottom hole assembly through fluid passageways provided within drill pipes 121. For example, while passing through BHA 122, the flow of drilling fluid can be channeled through a turbine/alternator sub-assembly included in the BHA 122 (not specifically shown in FIG. 1). The turbine/alternator subsection can be configured to convert the energy from the flow of drilling fluid into a mechanical rotational energy, which in turn can be used to drive an alternator portion of the sub-assembly, and thereby generate electrical power. The generated electrical power may then be conditioned and controllably applied to drill bit 123.

The electrical energy generated by the PPD assembly 126 may be controllably applied to the drill bit 123 and thereby to at least one of the one or more electrodes 227-229 via pulse-generating circuit 135. Pulse-generating circuit 135 may be utilized to repeatedly apply a large electric potential, for example over 30 kV, over 75 kV, over 100 kV, or up to or exceeding 150 kV, across one or more of the electrodes 227-229. Each application of electric potential is referred to as a pulse. When the electric potential across electrodes of a drill bit 123 becomes sufficiently large, an electrical, high current, and thus high power, discharge, or plasma arc forms through the material forming formation 113 and/or effluent drilling fluid 131 that is near the electrodes 227-229. The plasma arc provides a temporary electrical short between the electrodes, and thus allows electric current to flow through the arc inside a portion of the material forming formation 113 and/or effluent drilling fluid 131 at the borehole bottom surface 112. The plasma arc greatly increases the temperature and pressure of the portion of material forming formation 113 through which the arc flows and the surrounding formation and materials. The temperature and pressure are sufficiently high to vaporize any water or other fluids that might be proximate to or encompassed by the arc and may also vaporize part of the rock itself. The vaporization process creates a high-pressure gas and/or a plasma, which expands and, in turn, fractures the surrounding material forming formation 113.

The electrical energy, when applied for example to borehole bottom surface 112, acts to break up formation 113 in the vicinity of the at least one of the one or more electrodes 227-229, and thus advance the borehole 110 through the material forming formation 113. The exposure of the formation 113 and the drilling fluid to the electrical energy discharged from the drill bit 123 may, in addition to breaking up formation material, cause one or more downhole reaction that alters one or more chemical and/or physical properties of the formation material and/or drilling fluid that has been exposed to or has otherwise interacted with the electrical energy provided by drill bit 123.

Figure 3A:
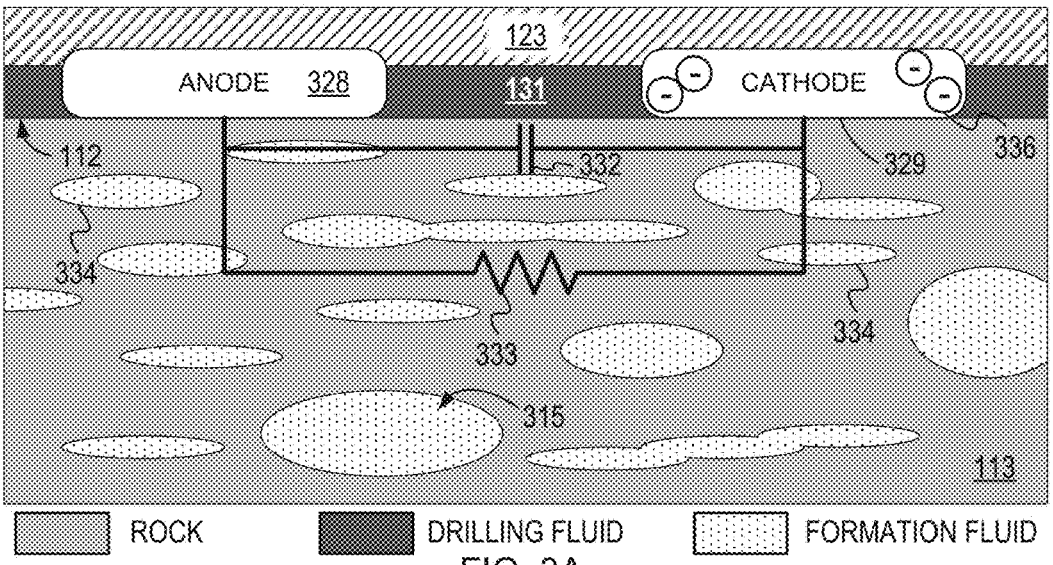
FIG. 3A depicts a schematic diagram of a drill bit having electrodes disposed at the bottom of a borehole in contact with a formation prior to a plasma discharge, according to one or more embodiment.
Figure 3B:
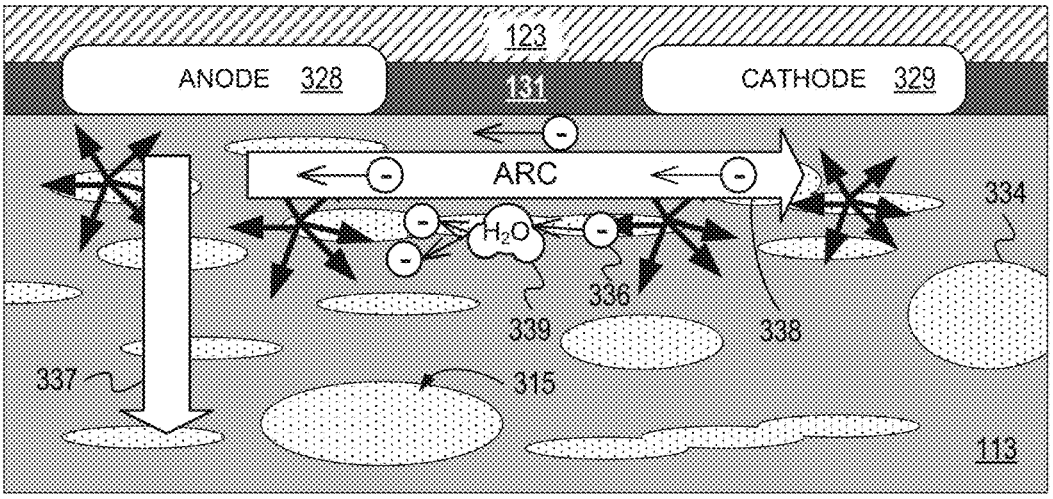
FIG. 3B depicts a schematic diagram of the drill bit having electrodes during the plasma discharge into the formation, according to one or more embodiment.
Figure 3C:
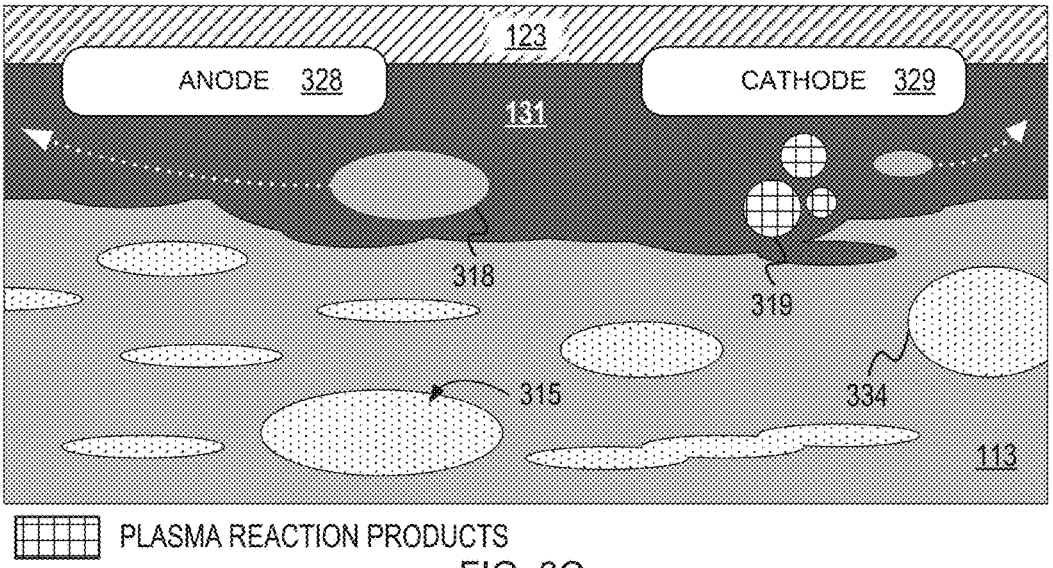
FIG. 3C depicts a schematic diagram of the drill bit having electrodes after the plasma discharge, according to one or more embodiment.

FIGS. 3A-3C schematically depict details of the interaction of the one or more electrodes of the drill bit 123 (e.g., electrodes 227-229) with the borehole bottom surface 112 and/or the effluent drilling fluid 131 to perform pulsed power drilling at three different points in time, according to one or more embodiment. In FIGS. 3A-3C, two of the electrodes are depicted disposed along the borehole bottom surface 112 in contact with the formation 113 prior to a pulse being generated. One electrode acts as anode 328 and a second electrode acts as cathode 329. For example, in on more embodiments or operation modes, anode 328 can be central electrode 228 and cathode 329 can be one or both of the outer electrodes 227 or 229. In other embodiments or operation modes, at least one of the outer electrodes (e.g., electrodes 227 or 229) can operate as the anode 328 and at least one of the central electrodes (e.g., central electrode 228) and another outer electrode can act as the cathode 329.

FIG. 3A depicts a schematic diagram of the drill bit 123 having electrodes, e.g., anode 328 and cathode 329, disposed along the borehole bottom surface 112 in contact with the formation 113 prior to a plasma discharge, according to one or more embodiment. In operation, one or more of the electrodes is charged by pulse-generating circuit 135, which induces charge carriers at the electrode formation interface-either electrons or holes which are theoretical charge carriers representing the absence of electrons. See, e.g., electrons 336 shown on cathode 329. When the electrodes are proximate or touching the formation 113, the formation 113 (formed of materials such as rock or stone), formation fluid 315 in pores or pore spaces 334 of the rock strata, and/or the effluent drilling fluid 131 from a dielectric between anode 328 and cathode 329. Formation fluid 315, sometimes called reservoir fluid, refers to naturally occurring liquids and gases contained in the formation 113 and can include hydrocarbons, water, and other gases, liquids, and dissolved minerals. The dielectric, before the plasma is applied, can be approximated as a resistor 333 in series with a capacitor 332, where the dielectric strength is a function of porosity, permeability, formation type, formation fluid composition, and composition of the effluent drilling fluid 131.

FIG. 3B depicts a schematic diagram of the drill bit 123 having electrodes (anode 328 and cathode 329) during a plasma discharge (i.e., a plasma) into the formation 113, according to one or more embodiment. When sufficient voltage is applied to the electrodes while the electrodes are proximate or touching the formation 113, current flows from the anode 328 to the cathode 329 (which corresponds to a flow of electrons 336 from the cathode 329 to the anode 328) to create a plasma discharge as a plasma arc 338. The plasma arc 338 can be defined as a plasma generated between the cathode 329 and anode 328 along with a significant transfer of current. Although not depicted, plasma arcs can also form between the electrodes and the formation 113. Plasma, as used herein, refers to the fourth state of matter, a high energy fluid, namely a highly conductive, ionized gas containing free electrons and positive ions (from which the electrons have been disassociated). Plasma is electrically conductive, can produce one or more magnetic fields and electrical currents, and can respond to electromagnetic forces.

The plasma arc 338 forms in the combination of effluent drilling fluid 131, formation 113, and formation fluid 315 when the applied voltage to the electrodes is above the dielectric breakdown voltage of the combination of effluent drilling fluid 131, formation 113, and formation fluid 315, for the downhole temperature and pressure. At voltages above breakdown, electrons separate from molecules, generating positive ions. The electrons have much smaller mass than the positive ions and accelerate in the electric field towards the anode 328. In a low-pressure plasma, the mean free path of the electrons can be long and they may experience significant acceleration-very fast electrons generate additional electrons through Townsend avalanche multiplication when they collide with positive ions or neutral molecules on their way to the anode 328. In a high-pressure plasma where free electrons can be drawn from ground, such as found when drilling in formation 113, the mean free path of the electron can be so short that avalanche electron multiplication is negligible. In either case, the increase in current generated by the plasma is encompassed by the term $I_{plasma}$. Plasma arc 338 can be detectable from its effect on current in the cathode 329, i.e., $I_{cathode}$, and/or the current in anode 328, i.e., $I_{anode}$, because $$I_{anode}=I_{cathode}+I_{formation}+I_{plasma} \tag{2}$$

where $I_{formation}$ is the current of the formation 113.

The value of Townsend current is given by Equations 3-4, below:

$$I = I_0 e^{\alpha_n d} \tag{3}$$

$$I = I_0 \frac{(\alpha_n - \alpha_p)\mathrm{Exp}[(\alpha_n - \alpha_p)d]}{(\alpha_n - \alpha_p)\mathrm{Exp}[(\alpha_n - \alpha_p)d]} \cong I_0 \frac{\mathrm{Exp}[\alpha_n d]}{1 - \alpha_p/\alpha_n)\mathrm{Exp}[\alpha_n d]} \tag{4}$$

where $I_0$ represents current generated at the cathode surface (which can be approximated as $I_0=I_{cathode}$), $\alpha_n$ is the first Townsend ionization coefficient, $\alpha_p$ is the secondary ionization Townsend coefficient, and d is the distance between the anode and cathode of a parallel plate capacitive discharge. The first coefficient $\alpha_n$ represents the number of particle pairs generated by a negatively charged particle (anion or electron) per unit length, where such a negative particle is moving from cathode to anode. The second coefficient $\alpha_p$ represents the number of charged particle pairs generated per unit length by a cation, during its collisions while moving from anode to cathode. Equation 3 considers only electrons traveling at speeds sufficient to cause ionization collisions (i.e., a non-thermal plasma), while Equation 4 also considers positive ion (i.e., cation) traveling fast enough to impart ionization energy to neutral particles (i.e., a thermal plasma).

For a downhole plasma where d is known, the plasma current can be determined or estimated based on an exponential fit to the anode and cathode currents. The exponential portion of the increase in current during the lifetime of the plasma results from the avalanche multiplication in the plasma. Current lost to the formation or ground can exhibit only minimal capacitive or inductive charging (i.e., current that depend exponentially on time) and is predominantly resistive in nature and therefore distinguishable from the plasma current.

The plasma arc 338 in the formation 113 leads to vaporization of formation fluid in pores 334, which causes expansion of the fluid (usually a liquid) in the pores as it is converted to a high-pressure vapor or gas, and leads to destruction of the rock. Formations without pore spaces, or with small, impermeable pore space, are also susceptible to pulsed power drilling. In such "dry" formations, the plasma arc 338 can occur through the rock itself, which then suffers from dielectric breakdown, creating fissures and fault lines along a current path. Vaporization of fluid can be a faster pulsed power drilling method, but both mechanisms can be active at the same time in the same portion of the formation 113 that is proximate to or touching the electrodes.

Electrons 336 are injected from the cathode 329 into the dielectric under the influence of the electric field generated between the anode 328 and the cathode 329. The electric field can be approximated for a parallel plate capacitor by Equation 5:

$$E = \frac{\Delta V}{d} \tag{5}$$

where E is the electric field (in Volts (V) per meter or another unit) for a parallel plate capacitor approximation for electrodes separated by a distance d and at a voltage difference of ΔV. The electric field between the anode 328 and the cathode 329 is not uniform if the formation 113 is not microscopically uniform, which is true for any formation strata with fluid filled pores. The average electric field can be approximated by Equation 6:

$$\overline{E} \sim \frac{\Delta V}{d} \tag{6}$$

where $\overline{E}$ is the average electric field in the dielectric between the electrodes, ΔV is the voltage drop from anode to cathode (or between the electrodes, generally) and d is the separation distance between the electrodes.

The electrons 336 accelerate in the electric field in the dielectric until they experience a collision with particle. The collision of charged particles in a plasma can generate an avalanche multiplication current. Similarly charged particles repel each other, but neutral and opposite polarity particles experience collisions at appreciable rates. The electron 336 collides with water molecule 339 leading to the generation of an additional electron. This collision is governed by the hydroxide ion chemical formation shown in Equation 7:

$$e^- + H_2O \leftrightarrow \frac{1}{2}H_2 + HO^- + 2e^- \tag{7}$$

where $e^-$ represents electrons and $HO^-$ represents hydroxide ions. Another reaction pathway generates hydroxyl radicals but no additional electrons, as shown in Equation 8:

$$e^- + H_2O \leftrightarrow \frac{1}{2}H_2 + HO\cdot + e^- \tag{8}$$

where HO represents a neutral hydroxyl radical, and where free radicals or radicals are electrically neutral molecules with at least one unpaired electron and can be very reactive. In this way, the plasma generates high energy particle collisions that produce chemical reactions downhole.

Plasma spark or sparking 337 occurs when a portion of the electric current travels not between the cathode 329 and anode 328, but out into the formation 113. A plasma spark can be defined as a non-directional or isotropic plasma without a directional current transfer. The portion of the power that generates a plasma spark 337 does not lead to appreciable current transfer between the anode 328 and cathode 329, i.e., electrons 336 are not appreciably accelerated between the cathode 329 and the anode 328—although current may flow to ground (not shown) or into the formation 113. As such, plasma spark 337 is detectable via a drawdown of voltage from the anode 328 and cathode 329. Like plasma arc 338, plasma spark 337 can vaporize fluid, breakdown rock, and contribute to drilling. At times, plasma spark 337 can be undesirable because they can unevenly form at one electrode, instead of dissipating power equally between both anode 328 and cathode 329. However, plasma spark 337 also may be useful in directionally modifying drilling such as when turning the borehole 110 is required.

Plasma arcs and plasma sparks have fundamentally different plasma temperatures and geometries, which lead to different high-energy transition states and chemical reactions. For example, plasma sparks typically have higher plasma temperatures than plasma arcs which affects the types of products generated in a downhole chemical reaction and their reaction rates. The determination of a ratio between plasma power generating a plasma arc and plasma power generating plasma sparking can be estimated via electrical measurements and further or iteratively refined based on concentration of chemical products and determination of reaction rates from surface stochiometric analysis, as described further below.

FIG. 3C depicts a schematic diagram of the drill bit 123 having the electrodes after the plasma discharge (i.e., plasma arc 338 and/or plasma spark 337) produced in the formation 113, according to one or more embodiment. The vaporization of the formation fluid 315 generates expansive gases. As the plasma is quenched, e.g., by equalizing the current between the anode 328 and the cathode 329, the gasses are dissolved back into the effluent drilling fluid 131. Formation solids (rocks or particulates), having been broken into smaller pieces by the plasma, are carried away as cuttings 318 by the effluent drilling fluid 131. The destruction of the solid matrix of the formation 113 frees formation fluid 315 formerly trapped in pore spaces within the rock. In one or more embodiment, the formation fluid and/or dissolved formation material from the regions where plasma was generated is no longer formation fluid but rather the reaction products 319 created as result of the plasma spark 337 or plasma arc 338. Although not shown, in other embodiments, the breaking of the formation matrix also releases unreacted formation fluid 315 into the effluent drilling fluid 131. The reaction products 319 and/or released unreacted formation fluid 315 travel to the surface dissolved or carried in the effluent drilling fluid 131 to be analyzed and categorized.

Figure 4:
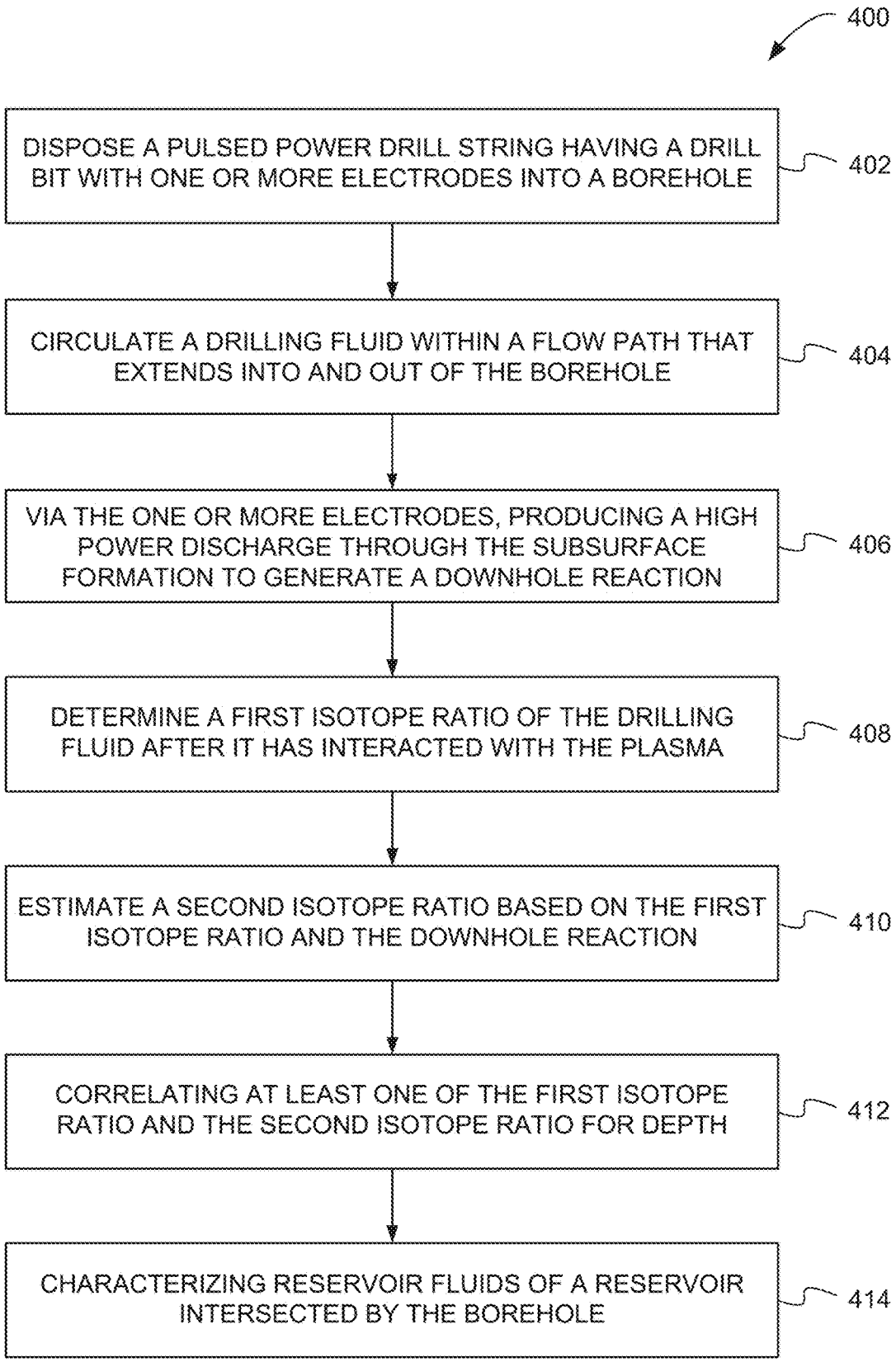
FIG. 4 is a flow chart depicting an example of a method for analyzing the isotopic composition of a fluid from the borehole while performing pulsed power drilling, according to one or more embodiment.

FIG. 4 is a flow chart depicting an example of a method 400 for analyzing the isotopic concentration of a fluid from a borehole while performing pulsed power drilling, according to one or more embodiment. The method (or processes or operations) are described as being performed by system 100 depicted in FIGS. 1, 2, and 3A-3C, for consistency with the earlier description.

At 402, pulsed power drilling begins with the disposing of the drill string 120, having drill bit 123 with one or more electrodes 227-229, into the borehole 110. At the very beginning of the drilling process, the drill string 120 may begin at the surface 103 that has no borehole and then start to remove earth to create the borehole 110. In one or more embodiment, the drill string 120 is disposed in the borehole 110 that has already been started by traditional drilling.

At 404, in conjunction with disposing the drill string 120 into the borehole 110, influent drilling fluid 130 is circulated through the drill string 120 and drill bit 123 using pump 141, into the borehole 110, specifically into the annulus 114, as described above with reference to FIG. 1. After flowing past the drill bit 123, the effluent drilling fluid 131, eventually circulates out of the borehole 110 to the fluid recondition system 142. As described above, when a downhole reaction has occurred at the one or more electrodes 227-229, the effluent drilling fluid 131 can differ from the influent drilling fluid 130 by having material, such as rock (e.g., cuttings 318), produced fluid (e.g., formation fluid 315), and reaction products 319, added to thereto or included therein. At least a portion of the effluent drilling fluid 131 is sampled or extracted via extraction system 144. In one or more embodiments, the circulation of fluid coincides with the actuation of the pulsed power drilling.

While the drilling fluid is circulating, at 406, the pulse-generating circuit 135 in the BHA 122 can produce a high power, high current, discharge, i.e. a plasma discharge, through the formation 113 via the one or more electrodes 227-229, such that at least one electrode operates as anode 328 and at least another one of the electrodes operates as cathode 329. As described above, with reference to FIGS. 3A-3C, the voltage applied to the one or more electrodes can create one or more plasma arc 338 or plasma spark 337 to break up the formation 113 at the borehole bottom surface 112, thereby advancing the drill bit 123 and also resulting in a change in composition of the influent drilling fluid 130 to effluent drilling fluid 131. As discussed above, the one or more plasma arc 338 or plasma spark 337 create a downhole chemical reaction that alter the composition of at least some of the formation fluid 315 resulting in reaction products 319.

At 408, the analysis system 160 determines a first isotope ratio of the effluent drilling fluid 131 after it has interacted with the plasma arc 338 or plasma spark 337, e.g., via a sampling tool disposed in the borehole 110 or after the effluent drilling fluid 131 exits the borehole 110. The first isotope ratio can be referred to in some instances as the "raw" isotope ratio. As described above, the extraction system 144 directs extracted or sampled drilling fluid (gas, liquid, or solids, e.g., cuttings) to the analysis system 160. Instrumentation 161 provides one or more measurements or determined outputs based on the extracted or sampled fluid to the computer system(s) 162 for determination of the first isotope ratio. In one example, the extraction system 144 includes a gas extraction device that provides continuous or sampled gas to instrumentation 161 that includes a gas chromatograph (e.g., one or more GC-IRMS etc.) and/or one or more mass spectrometer. The instrumentation 161 in combination with computer system(s) 162 can output an isotope ratio or isotope amount. The output of the first isotope ratio can be per sample or, for a continuous or semi-continuous measurement, a log of the first isotope ratio over time. In one or more embodiment, the first isotope ratio may be data points or a data stream over time. As discussed later, these data points or this data stream can be correlated with one or more depths of the borehole 110.

In one or more embodiment, the analysis system 160 determines a concentration or amount of two respective isotopes of a same element (for example hydrogen, carbon, oxygen, or the like) in a sample of the effluent drilling fluid 131, wherein the sample is obtained by at least one of (1) extracting or sampling gas from the effluent drilling fluid with a gas extraction system and (2) sampling a liquids from the effluent drilling fluid (as described with reference to FIG. 1). In one or more embodiments, the analysis system 160 determines a concentration or amount of two respective isotopes of a same element (for example hydrogen, carbon, oxygen, or the like) in a sample of the influent drilling fluid 130, wherein the sample is obtained by at least one of (1) extracting or sampling gas from the influent drilling fluid with a gas extraction system and (2) sampling a liquids from the influent drilling fluid (as described with reference to FIG. 1). The concentration or amount of the two respective isotopes correlates to an isotope ratio, as described above. The concentration or amount of the two respective isotopes in the influent drilling fluid 130 can be compared to the concentration or amount of the two respective isotopes in the effluent drilling fluid 131 to account for recirculation when estimating the second isotope ratio.

The term "data stream" to refer to a unidirectional stream of data flowing over a data connection between two entities in a session. The entities in the session may be interfaces, services, etc. The elements of the data stream will vary in size and formatting depending upon the entities communicating with the session. Although the data stream elements will be segmented/divided according to the protocol supporting the session, the entities may be handling the data at an operating system perspective and the data stream elements may be data blocks from that operating system perspective. The data stream is a "stream" because a data set (e.g., a volume or directory) is serialized at the source for streaming to a destination. Serialization of the data stream elements allows for reconstruction of the data set. The data stream is characterized as "flowing" over a data connection because the data stream elements are continuously transmitted from the source until completion or an interruption. The data connection over which the data stream flows is a logical construct that represents the endpoints that define the data connection. The endpoints can be represented with logical data structures that can be referred to as interfaces. A session is an abstraction of one or more connections. A session may be, for example, a data connection and a management connection. A management connection is a connection that carries management messages for changing state of services associated with the session.

At 410, the analysis system 160 estimate or determine a second isotope ratio based on the first isotope ratio and the downhole reaction, according to one or more embodiment. The second isotope ratio can be referred to in some instances as the "true" or "corrected" isotope ratio, as it represents the isotope ratio as if the downhole reaction had not occurred. This second isotope ratio is important as this allows a comparison to other wells and geological data that is not from pulsed power drilling. For example, the second isotope ratio logged over depth from a borehole, or a portion thereof, drilled with pulsed power drilling can be compared to an isotope log of a neighboring borehole drilled or being drilled with traditional drilling, e.g. one known or thought to be connected to the same subsurface reservoir. With only the first isotope ratio, such a comparison would not be as accurate, or worse give false information. Thus, the estimated second isotope ratio can aid in characterizing of the reservoir, as described at 414 below.

Figure 5:
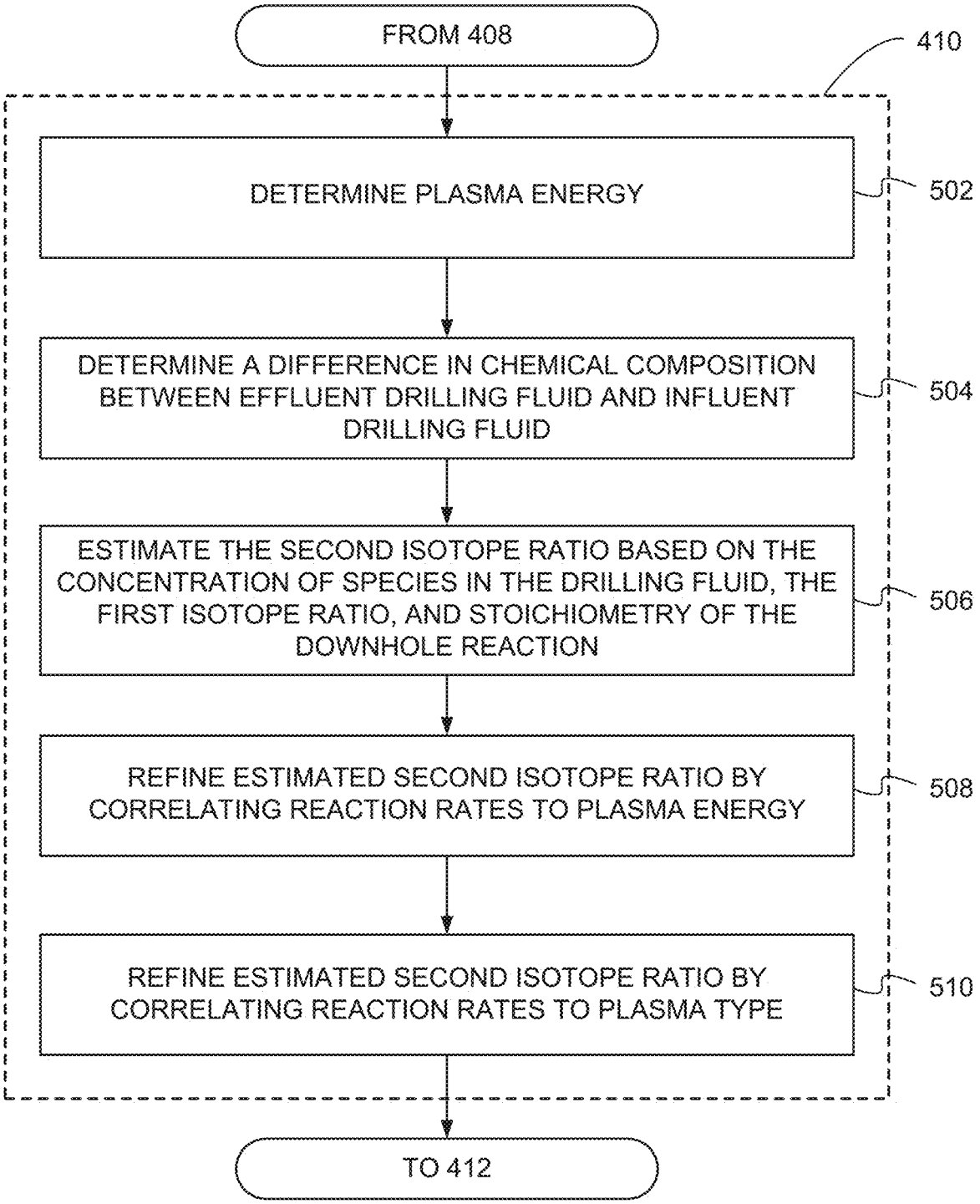
FIG. 5 is flow chart depicting details of the process of determining the second isotope ratio based on a first ratio and a downhole reaction, according to one or more embodiment.

FIG. 5 is a flow chart depicting further details of the process of determining the second isotope ratio based on the first ratio and the downhole reaction. At 502, the plasma energy is determined by measuring voltage and/or current on at least one electrode. Based on the measured voltage and/or current, the plasma power can be determined and thereby the plasma energy. For example, analysis system 160 can calculate, e.g., via the computer system(s) 162, the plasma power based on the voltage and/or current measured at least one of the one or more electrodes 227-229 and/or at least one of the anode 328 and cathode 329.

The power added to the system is determined by the current flowing through and the voltage drop over the system. If the cathode 329 and the formation 113 are at 0V or ground, then the total power added to the system is given by Equation 9:

$$P=I_{anode}V_{anode} \tag{9}$$

where P is the plasma power, $I_{anode}$ is the current measured at the anode 328, $V_{anode}$ is the voltage measured at the anode 328. If the cathode is not also a ground source or if information about the current and voltage at the cathode is known, then the power added into the system is given by the approximation of Equation 10:

$$P=I_{anode}V_{anode}-I_{cathode}V_{cathode} \tag{10}$$

where P is the plasma power, $I_{anode}$ is the current measured at the anode 328, $V_{anode}$ is the voltage measured at the anode 328, $I_{cathode}$ is the current measured at the cathode 329, $V_{cathode}$ is the voltage measured at the cathode 329.

The plasma power, i.e., the power consumed to generate the plasma, can be assumed to account for the power input into the system. The plasma power approximation can be iteratively updated as a function of time. For a system where only the current at one electrode or the total power added to the system is known, the plasma power can be correlated to reaction rates, activation energies, and product concentrations instead of directly calculated. Pulsed plasma discharges of similar power can be assumed to have similar properties, including spark vs. arc ratio, reaction rates, etc.

The power balance represents an instantaneous energy balance, where power is energy per unit time. The total energy balance of the system also provides information about the plasma power. For a plasma pulse of known duration, energy balance equations can be substituted for power balance equations. In this case, the total energy of formation of the products relates to the power or energy of the plasma. If products and product concentrations of the chemical reactions are known, a total chemical energy balance can be determined based on the enthalpy of formation of the product species and the temperature and pressure at which the reactions occur.

In either case, the power or energy of a given plasma pulse is correlated to the products of such a reaction which reach the surface at a time delayed from the reaction. Traditional mud logging correlates drilling fluid chemical constituents to the depth at which they entered the borehole. Pulse plasma mud logging additionally correlates drilling fluid chemical constituents to a specific reaction time, current, and voltage in order to back calculate formation fluid properties. The lag between pulsed plasma reaction and drilling fluid arrival at the surface is determined based on drilling rate, circulation rate, and drill depth.

For a DC plasma, current will vary with time, even during the plasma pulse itself. Before the plasma is generated, the current is low and the resistivity between dielectric between the anode 328 and cathode 329 (which can be modeled as the drilling fluid resistivity, formation rock resistivity, and formation fluid resistivity in parallel) is high. The voltage between the anode 328 and cathode 329 builds as the cathode 329 is charged until the voltage applied over the dielectric is greater than the dielectric's breakdown voltage and a plasma is generated.

The resistivity of the plasma is low, and it can be modeled as a conductor of zero resistivity between the anode 328 and cathode 329. If there are available free electrons in the system, an approximation applicable when electrons can be drawn from ground or stripped from water molecules in the drilling fluid, the current generated by the plasma can be estimated by the Townsend discharge equations (Equations 2-3, above) or determined via Kirchhoff's law from the other known currents.

A plasma is overall electrically neutral—the electrons generated by the avalanche cascade reactions are compensated by free electrons absorbed from ground or generated by ionization. The number of positive ions (cations) and electrons (where the contribution of anions can be approximated as $n_e \approx 0$) are approximately equal. The degree or fraction of ionization for a plasma is given by Equation 11:

$$f_i = \frac{n_e}{(n_e + n_0)} \tag{11}$$

where $n_e$ is the number of electrons and $n_0$ is the number of neutral atoms or molecules.

Each particle in the plasma has a kinetic energy. Because there are so many electrons, ion, and atoms or molecules, the kinetic energy is oven expressed as an energy distribution or particle temperature. For a Maxwell-Boltzmann distribution, the plasma temperature of electrons is given in Equation 12:

$$T_e = \frac{2}{3}\frac{\langle E \rangle}{k_B} \tag{12}$$

where $\langle E \rangle$ is the average plasma energy and $k_B$ is the Boltzman constant. The plasma temperature of electrons can be estimate from the average plasma energy and the Boltzmann constant. Electron temperature is a fundamental measure of the energy of the electrons in a plasma and is used to calculate other plasma properties, such as collision rate, mean free path, etc., and is often given in units of Kelvin (K) or electron Volts (eV).

Plasmas are classified as either thermal, where anions, cations, and electrons have similar kinetic energy (i.e., are in thermal equilibrium) and non-thermal, where electrons alone have kinetic energy proportional to the plasma energy. The first plasma of the plasma pulses generated is generally a non-thermal plasma where the electrons of the plasma have a higher kinetic energy than the ions and molecules of the plasma. Thermal plasmas are generated from non-thermal plasmas as energy added to the plasma in the form of current and voltage increased the kinetic energy of the charged particles until they reach the same kinetic energy as the electrons. Thermal plasma are more common in AC and long lifetime plasmas, but can occur in DC plasmas and pulsed plasmas where the dielectric is sufficiently heated before the plasma is initiated (either by environmental heating or by previous plasma produced through the same dielectric). For a thermal plasma approximation as shown in Equation 13 below:

$$T_a=T_c \approx T_h=T_e \tag{13}$$

where the anion temperature $T_a$ and cation temperature $T_c$ are equal to the heavy particle kinetic energy $T_h$—energy is added to the motion of the charged particles by the electric field based on magnitude of the charge not polarity.

Reaction rate constants for products generated in a plasma or at the quenching of the plasma depend on both the temperature of the plasma—electron temperature and heavy particle temperature—and upon the total ionization. By determining the reaction rates based on chemical concentrations in the drilling fluid, the plasma temperatures can be monitored.

The average plasma energy $\langle E \rangle$ is related to both the energy applied to the plasma and to the electron temperature. The plasma power is related to the potential energy difference over the plasma (in Volts) times the work of moving the current (in Amperes) through the electric field. Power and energy are related, where power is energy per unit time (such as Watts), as shown in Equations 14 and 15 below.

$$\text{Power} = \frac{\text{Energy}}{\text{Time}} \tag{14}$$

$$\text{Power} = \frac{\partial}{\partial t}\text{Energy} = \frac{\langle E \rangle}{\Delta t} \tag{15}$$

Reaction rates are a function of plasma temperature (which is a measurement of plasma energy), which means that plasma temperature can be calculated or correlated to measured reaction rates. Plasma power can be approximated from the power added to the system, and from the approximate plasma power and the plasma duration an average plasma energy can be calculated. By comparing these two measures of plasma energy, the energy system can be checked for energy loss (i.e., energy lost to the formation can be detected). Either method can be used to approximate the other.

At 504, a difference in chemical composition between the effluent drilling fluid 131 and the influent drilling fluid 130 is determined. The composition of the effluent drilling fluid 131 can be described by Equation 16, $$D_E = D_I + F + P \tag{16}$$

where $D_E$ is the measurement of the effluent drilling fluid 131 at time t, $D_1$ is the measurement of the influent drilling fluid 130, F is unreacted formation fluid 315 released during the breaking of the formation 113, and P are the reaction products 319. When unreacted formation fluid 315 is included in the effluent drilling fluid 131, the system can be described as having "influx." When the volume of effluent drilling fluid 131 is less than the volume of influent drilling fluid 130 this is referred to as a "loss," as this likely indicates drilling fluid has invaded the formation 113 and thus doesn't flow back to the surface 103.

In one or more embodiment, a separate measure of the influent drilling fluid 130 may not be required. As the drilling fluid flows in a loop, if there is no influent drilling fluid measurement, influent drilling fluid 130 can be assumed to equal a measure of effluent drilling fluid 131 before drilling has commenced and thereafter (assuming no influx from formation or loss to the formation) can be assumed to be a measure of the effluent drilling fluid 131 at a previous time interval. As such, the composition of the effluent drilling fluid 131 can be described by Equations 17 and 18:

$$f \text{ or } t=0,\ D_{E_t} = D_{E_{t-1}} \tag{17}$$

$$f \text{ or } t>0,\ D_{E_t} = D_{E_{t-1}} + F_t + P_t \tag{18}$$

where $D_{E_t}$ is the measurement of the effluent drilling fluid 131 at time t, $D_{E_{t-1}}$ is the measurement of the effluent drilling fluid 131 at a time just before $D_{E_t}$, $F_t$ is the unreacted formation fluid released during breaking of the formation 113, and $P_t$ are the reaction products 319. In one or more embodiments, when all the formation fluid 315 reacts with the plasma spark 337 or plasma arc 338 (or it is assumed to have all reacted) then the difference between effluent drilling fluid 131 and influent drilling fluid 130 is only the reaction products 319, thereby simplifying the determination of the reaction products.

Based on the above, analysis system 160 can determine the portion of the effluent drilling fluid 131 that results from pulsed power drilling, i.e., the portion that has interacted with the plasma and thus includes reaction products 319 and, optionally, unreacted formation fluid. For example, computer system(s) 162 can determine the change in drilling fluid species concentration by subtracting the concentrations of species found in the influent drilling fluid 130 pumped downhole from the concentration of species found in the effluent drilling fluid 131.

At 506, the second isotope ratio is estimated based on the concentrations of species in the drilling fluid, the first isotope ratio, and estimated stoichiometry of the downhole reaction. Based on the change in concentration that corresponds to the influx of formation fluid 315 and reaction products generated by the plasma spark 337 or plasma arc 338, the computer system(s) 162 can solve a system of equations corresponding to stochiometric relationships and to reaction rate equations between the products and the potential reactants. For known or solvable stoichiometry, reactant concentrations can be calculated directly. For most systems, the stochiometric equations generate a set of solvable equations with more degrees of freedom than encompassed by-product concentration alone. For these systems, estimated reaction rate constants and reaction kinetics can be applied in order to determine reactant concentrations.

For a reaction between reactants A and B to form product Z the reaction can be described by Equation 19:

$$a \cdot A + b \cdot B \rightarrow z \cdot Z \tag{19}$$

where a, b, and z are stoichiometric coefficients, A and B the reactants, and Z is the product. The rate at which a chemical reaction takes place, i.e., the rate at which reactants turn into products, is given by a generalized reaction rate, which depends on a reaction rate constant k(T) (which can be itself a function of temperature, pressure, and activation energy) and on the concentration of reactants (usually in units of moles per unit volume). The reaction rate for a generalized $m+n^{th}$ order reaction is shown in Equation 20, below, for a rate-limiting step involve molecules of species A and B.

$$r = k(T)[A]^m[B]^n \tag{20}$$

where r is the reaction rate, k is a reaction rate constant (which is a function of temperature T), [A] and [B] are the molar concentrations of reactants A and B from Equation 19, respectively, and exponents m and n are partial orders of the reaction.

The order of the reaction (zeroth order, first order, etc.) depends upon the reaction mechanisms and the rate-limiting step in the reaction and how many and which species of molecules participate in the rarest or slowest collision. For direct current (DC) plasmas with lifetimes in the microsecond (s) to second range, many hydrocarbon formation reactions depend on intermediate steps involving hydroxyl free radicals, carbonyl free radicals or other free radicals with very short lifetimes, where free radical formation is therefore the rate-determining step. Hydroxyl free radical formation and concentration is dependent on water concentration, not hydrocarbon concentration, and upon plasma energy and properties including plasma temperature and geometry. This gives rise to many zeroth and first order reaction rates for generation of alkenes, alkynes, aromatics, and other unsaturated hydrocarbons from alkanes. A zeroth order reaction rate is given by Equation 21:

$$r=[A]^0k(T)=k(T) \tag{21}$$

where r is the reaction rate, k(T) is the reaction rate constant for a reaction with the rate-limiting step that is independent of reactant concentration, and where $[A]^0$ is a reactant concentration. A zeroth order reaction rate does not depend on the concentration of the reactants and has a rate constant with units of mol/s or equivalent. A first order reaction rate is given by Equation 22:

$$r=k(T)[A]=k(T)[A]^1 \tag{22}$$

where r and k(T) are the reaction rate and reaction rate constant, respectively. A first order reaction rate depends in the first order (i.e., $[A]^1$) on a single species of the reactants and has a rate constant with units $s^{-1}$ or equivalent.

The reaction rate constant k(T) depends on temperature and can be approximated using the Arrhenius equation, as shown in Equation 23 below.

$$k(T)=Ae^{-E_a/RT} \tag{23}$$

where A is a pre-exponential factor, sometimes called the Arrhenius constant; $E_a$ is the activation energy; T is the absolute temperature in kelvin, and R is the universal gas constant. Alternatively, the Arrhenius equation can be written as Equation 24:

$$k(T) = Ae^{-E_a/k_BT} \tag{24}$$

where $E_a$ is the activation energy in units of $k_BT$ and $k_B$ is the Boltzman constant.

The Arrhenius equation for $C_{12}$ can be described by Equation 25:

$$k_{C_{12}} = A_{C_{12}}e^{-E_a^{C12}/RT} \tag{25}$$

where $k_{C_{12}}$ is the reaction rate constant for $C_{12}$; $A_{C_{12}}$ is the Arrhenius constant for $C_{12}$; $E^{12}$ is the activation energy for $C_{12}$; T is the absolute temperature in kelvin, and R is the universal gas constant. The Arrhenius equation for $C_{13}$ can be described by Equation 26:

$$k_{C_{13}} = A_{C_{13}}e^{-E_a^{C13}/RT} \tag{26}$$

where $k_{C_{13}}$ is the reaction rate constant for $C_{13}$; $A_{C_{13}}$ is the Arrhenius constant for $C_{13}$; $E_a^{C_{13}}$ is the activation energy for $C_{13}$; T is the absolute temperature in kelvin, and R is the universal gas constant. For most isotopes the Arrhenius constant is the same (or at least can be assumed so for calculations). As such for carbon isotopes, $$A_{C_{12}}=A_{C_{13}} \tag{27}$$

leading to Equation 28:

$$k_{C12}/k_{C13} = e^{-\left(E_a^{C12}-E_a^{C13}\right)/RT} \tag{28}$$

In addition to the above, a rule of thumb for heavy atom isotope effects is that the maximum isotopic rate ratio is proportional to the square root of the inverse ratio of isotopic masses. Thus, the ratio of the reaction rates for $C_{12}$ to $C_{13}$ can be expressed as Equation 29:

$$k_{C_{12}}/k_{C_{13}}=\sqrt{13/12}=1.04 \tag{29}$$

While shown for carbon isotopes the same calculation could be applied for other isotopes of interest, e.g., hydrogen, oxygen, etc. These equations related to the chemical reaction can be used in estimating the second isotope ratio.

Formation fluid can be approximated to a first order as containing alkanes, naphthenes (which is a generic name for the family of cycloalkanes), and water. Alkanes, which the general chemical formula $C_nH_{2n+2}$, contain single carbon to carbon bonds (σ bonds) between n $sp^3$ hybridized carbon atoms. Alkanes are saturated hydrocarbons which contain no carbon-carbon double bonds (π bonds) but are rather full hydrogenated—that is the carbon backbone or carbon chain is bonded to the maximum number of hydrogen atoms possible. Naphthenes, which are cyclic alkanes where the carbon chain loops back on itself, have the general chemical formula $C_nH_{2(n+1-r)}$ where n is the number of carbons in the cycloalkane and r is the number of rings in the naphthene molecule. Formation fluid can also contain water, such as salt water, when emanating from water rich rock formations or strata.

The generalized chemical equation for the plasma reaction is approximated by Equation 30, below:

$$\begin{aligned}&A_n\cdot C_nH_{2n+2}+B_{n,r}\cdot C_nH_{2(n+1-r)}+D\cdot H_2O\rightarrow E_n\cdot C_nH_{2n+2}+\\&F_{n,r}\cdot C_nH_{2(n+1-r)}+G_n\cdot C_nH_{2n}+I_n\cdot C_nH_{2n-2}+J\cdot CO_2+\\&K\cdot O_2+L\cdot H_2\end{aligned} \tag{30}$$

where $A_n$ and $B_{n,r}$, are stoichiometric coefficients for each of the reactant hydrocarbon species, $C_nH_{2n+2}$ are alkanes, $C_nH_{2(n+1-r)}$ are naphthenes, $E_n$, $F_{n,r}$, $G_n$, and $I_n$ are stoichiometric coefficients for each of the product hydrocarbon species; $C_nH_{2n}$ are alkenes, $C_nH_{2n-2}$ are alkynes and D, J, K, L are stoichiometric coefficients for water, carbon dioxide, oxygen, and hydrogen, respectively.

The stoichiometric coefficients for each of the hydrocarbon species depend both on the number of carbons of the type of hydrocarbon (i.e., n) and the isomer (or atomic arrangement) of those carbons, but can be approximated as independent of isomeric configuration in order to simplify measurements. Table 1, below, contains names and formulas alkanes, alkenes, and alkynes as a function of the number of carbons they contain.

TABLE 1

| Common Hydrocarbons | | | | | | | | | |
|---|---|---|---|---|---|---|---|---|---|
| n | Formula | Alkane | Isomer | Formula | Alkene | Isomer | Formula | Alkyne | Isomer |
| 1 | $CH_4$ | Methane | 1 | | | | | | |
| 2 | $CH_3CH_3$ | Ethane | 1 | $CH_2{=}CH_2$ | Ethene | 1 | $HC{\equiv}CH$ | Acetylene | 1 |
| 3 | $CH_3CH_2CH_3$ | Propane | 1 | $CH_3CH{=}CH_2$ | Propene | 1 | $HC{\equiv}CCH_3$ | Propyne | 1 |
| 4 | $CH_3(CH_2)_2CH_3$ | Butane | 2 | $CH_3CH_2CH{=}CH_2$ | Butene | 4 | $CH_3C{\equiv}CCH_3$ | Butyne | 2 |
| . . . | | | | | | | | | |
| 40 | $C_{40}H_{82}$ | | | $C_{40}H_{80}$ | | | $C_{40}H_{78}$ | | |

As the molecules become larger (i.e., as n increases) the number of isomer molecules for each chemical formula increase, where isomers are various physical arrangements and chemical bonds possible for the same atoms. For n>2, polyunsaturated hydrocarbons also occur (i.e., hydrocarbons with two or more double bonds). Unsaturated hydrocarbons such as alkanes, are carbon molecules that contain only hydrogen and carbon and have the maximum number of hydrogen constituents possible for the given amount of carbon atoms. The ability to detect or differentiate hydrocarbons, including isomers, from one another depends on the specificity of instrumentation and is non-trivial.

In general, the products of the chemical reaction of Equation 30 have higher enthalpy or energy of formation that the reactants. This higher energy corresponds to the energy balance, where the energy added to the plasma is stored in higher order chemical bonds and endothermic reactions are favored by high energy transition states. The stoichiometry balance of the reaction can be determined based on the measured composition of the effluent drilling fluid 131 after it has interacted with the plasma.

Figure 6A:
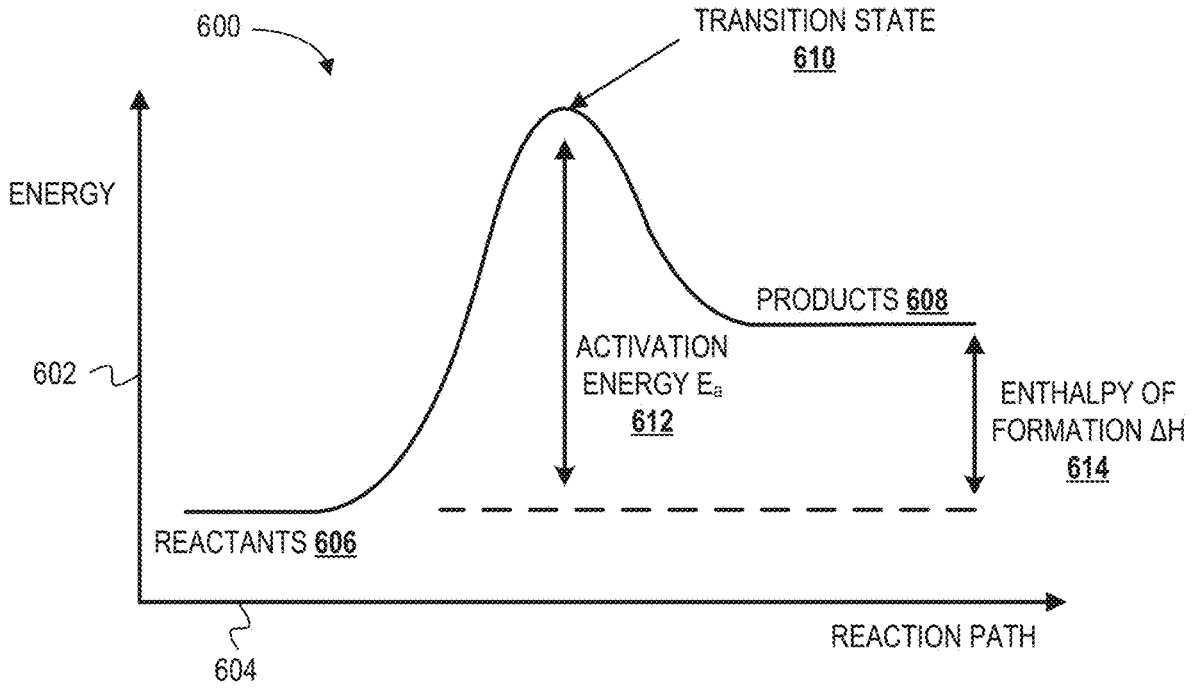
FIG. 6A depicts an example line graph of the reaction kinetics and reaction path of an example plasma-mediated chemical reaction, according to one or more embodiment.

To help illustrate, FIG. 6A depicts an example line graph of the reaction kinetics and reaction path of an example plasma-mediated chemical reaction, according to one or more embodiment. In particular, FIG. 6A depicts a graph 600 having a y-axis for energy 602 and an x-axis for a reaction pathway 604. The graph 600 depicts example reaction kinetics and molecular energies for example reactants and products of a pulse plasma. The plasma energy, which is the energy added to the system consumed to generate the plasma, can create highly energized particles, both kinetically energized and energized electronically above the ground state. Energized molecules and atoms therefore interact more frequently and can form transition states favorable to reaction. Graph 600 depicts an example reaction path or pathway for a set of reactants, their intermediate transition state, and the final products of the example reaction. Activation energy $E_a$ 612 is the energy per set of reactants or per reaction needed to reach transition state 610, where the transition state 610 is a complex formed between the atoms of the reactant molecules that is the highest energy state during the chemical transformation from the reactant species to the product species.

For most of the hydrocarbon reactions occurring in the plasma, reaction products 608 will have a greater enthalpy of formation 614 than reactants 606 (i.e., higher energy 602). Enthalpy of formation is a measure of the energy contained within a molecule as a sum of the energies contained within the chemical bonds between the constituent atoms. The plasma energy can be defined as the total energy in the plasma. The plasma energy added to the fluid is stored in higher order carbon bonds. Each molecular reaction can store the enthalpy of formation 614 (as an amount of energy) within the reaction products' 608 chemical bonds. The reaction energy, including the activation energy $E_a$ 612 and the enthalpy of formation 614, can be defined as the energy needed for a set of reactants 606 to reach the transition state 610 or stored in the reaction products 608. The reaction energy can be measured on a per reaction or molar basis. When species collide and react, the frequency at which the transition state 610 arrangement of the hydrocarbon is reached is a function of the kinetic energy added to the molecule through absorption of a photon, stabilized via hydroxyl, or other catalysis processes. In a plasma, the kinetic energy of the particles is high because the plasma energy is high. The plasma energy is a measure of the kinetic energy of the particles and molecules within the plasma, and higher energy transition states are allowed (and occur more frequently), as shown along the reaction pathway 604.

In the graph 600, the reaction pathway 604 is a simplified timeline of the reaction, going from the reactants 606 to the reaction products 608 (showing an intermediate step—the transition state 610). Reaction mechanisms, which include possible reaction pathways and intermediate steps, can be much more complicated. A reaction mechanism can be defined as the series of steps and chemical rearrangements that occur during a reaction at a molecular level, where reactants transform into products. A reaction mechanism may include intermediate steps, some of which can lead to formation of multiple different reaction products. A reaction path or reaction pathway can be defined as the method or steps of the reaction mechanism which lead from a set of reactants to a set of reaction products. A reaction can have more than one pathway that generates identical reaction products from reactants (as will be discussed in reference to FIG. 6B), and each pathway can have a different activation energy and reaction rate. For instance, catalysts can stabilize transition states thereby lowering activation energies and increasing the speed of a given reaction rate, but even in catalyzed reactions a portion of the products may be generated through the higher energy uncatalyzed transition state. Reactions, including intermediate reaction steps, can also be reversible which means that a significant portion of the reaction products re-react to re-from the reactant species. Dehydrogenation reactions tend to be irreversible because the gaseous reaction products quickly dissociate from the hydrocarbon species, but transition states in dehydrogenation reactions are likely to form reaction products or to re-form reactants.

Plasma energy (of the entire plasma) and reaction energy (of each individual chemical reaction) can be correlated—higher plasma energy favors reactions with larger activation energies and greater enthalpy of formation. The concentration of product species multiplied by the enthalpy of formation of each species generates a total reaction energy for the chemical reactions within the plasma that can be compared to the plasma energy.

Figure 6B:
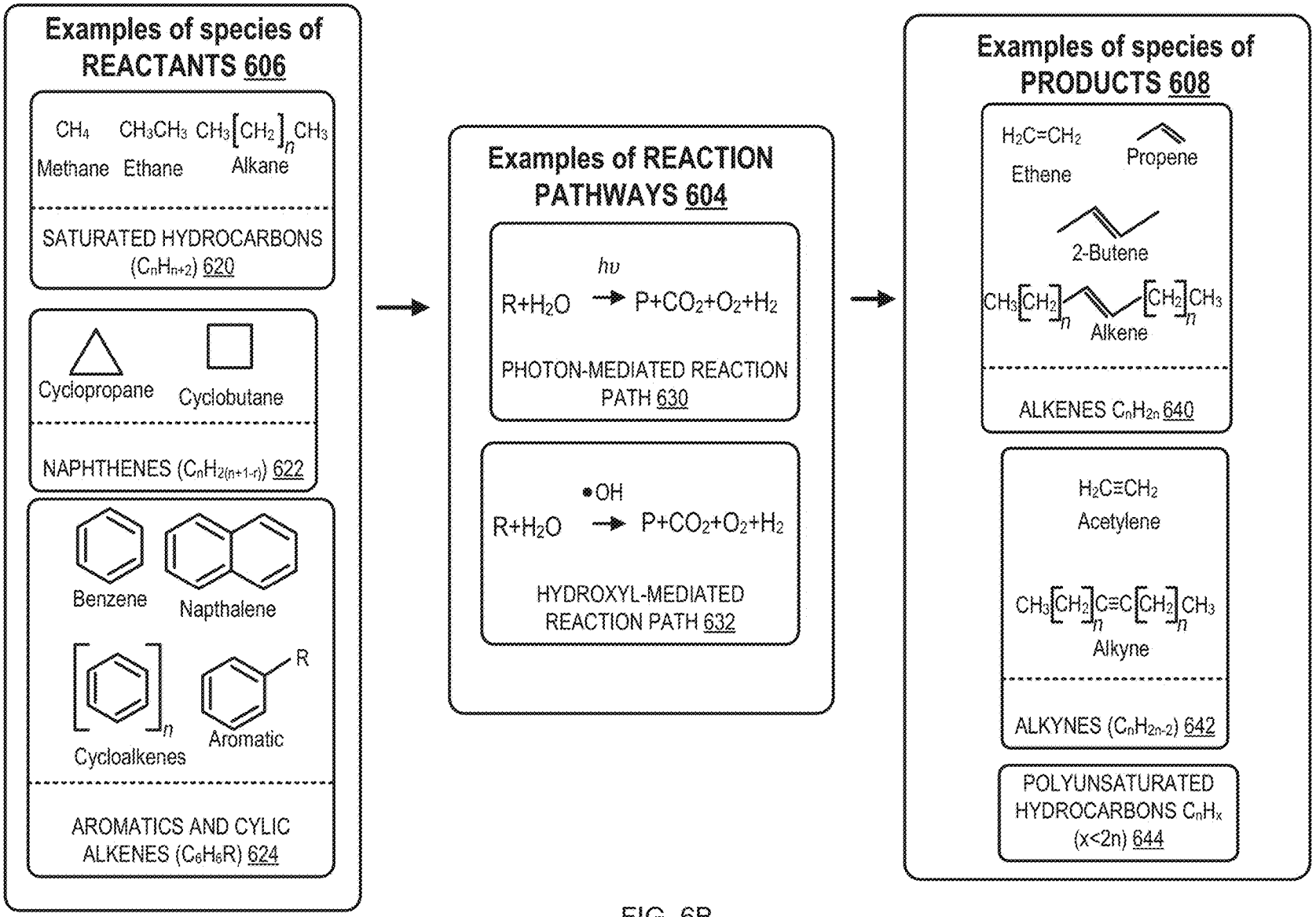
FIG. 6B depicts example reactants and products as well as example reaction pathways, according to one or more embodiment.

To further illustrate, FIG. 6B depicts example reactants and products as well as example reaction pathways, according to some embodiments. FIG. 6B depicts examples of species of reactants 606, examples of reaction pathways 604, and examples of species of reaction products 608. The second isotope concentration can be determined from the reactant concentration, the first isotope ratio, and the previously described system of equations. To calculate the reactant concentration a set of equations based on reaction rate constant and final or product concentration can be generated. A generic reaction can be described by Equation 31:

$$A \rightarrow Z \tag{31}$$

where A is a generic reactant and Z is a generic product. If a first order reaction, then the reaction rate can be described by Equation 22 above and the final concentration [Z] can be measured or determined during drilling fluid analysis.

Product species Z can include at least one species from at least one of alkenes 640, alkynes 642, polyunsaturated hydrocarbons 644, and any of those species included corresponding to reactant species A. Reactant species A can include species from at least one of the alkanes or saturated hydrocarbons 620, the naphthenes 622, and the aromatics and cyclic alkenes 624, as can be found in the formation fluid.

If the reaction rate constant k(T) is also known or previously determined, the reactant concentration [A] (which is the formation fluid concentration) for the generic product Z is directly calculable according to Equation 32-34 below.

$$[Z] = r * \Delta t = k(T)[A] * \Delta t \tag{32}$$

$$[Z] = \int r dt = \int k(T)[A] dt \tag{33}$$

$$[A] = \frac{[Z]}{k(T) * \Delta t} \tag{34}$$

where r is the reaction rate; k(T) is the reaction rate constant as a function of temperature; [Z] is the molar concentration of the product Z; [A] is the molar concentrations of reactant A; and Δt is the time interval. Concentration changes may be large enough that the change in reactant concentrations favors the use of integrals (as shown in Equation 33) instead of discrete analysis (as shown in Equations 32 and 34). The instantaneous product concentrations may not be known, as can occur when drilling fluid circulation prevents instantaneous measurement of chemical reaction products. If the instantaneous concentrations are not known, the reaction rate and reactant concentration can be approximated using integral approximation, such as for an exponential concentration approximation, or discrete analysis.

Product molecule(s) Z can be generated from a reactant molecule(s) A via a photon-mediated reaction pathway 630 or a hydroxyl-mediated pathway 632, among other pathways. The ratio between reactions catalyzed by light and those catalyzed by hydroxyl free radicals can correspond roughly to the ratio between plasma arc and plasma spark.

For the set of alkane dehydrogenation reactions (which can be considered to be the opposite of cracking reactions) encompassed by Equation 28 (set forth above), the molar concentrations of hydrogen, carbon dioxide, and oxygen gases can be determined at the surface. From the oxygen mass balance of the chemical reaction, the relationship between coefficients D, J, and K is determined by Equation 35:

$$D=2(J+K) \tag{35}$$

where D is the stochiometric coefficient for water, J is the stochiometric coefficient for carbon dioxide, and K is the stochiometric coefficient for hydrogen as defined in the chemical reaction of Equation 30. This allows the initial concentration of water to be calculated based on the measured molar concentrations of carbon dioxide and oxygen measured at the surface, as is shown in Equation 36, below.

$$[H_2O]=2([CO_2]+[O_2]) \tag{36}$$

The mass balance of the carbon and hydrogen atoms can be complicated by the multiplicity of the hydrocarbon species. The chemical analysis does not necessarily determine a concentration for each isomer of the saturated and unsaturated hydrocarbons. Isomer concentrations, where available, can refine available mass balance equations. The chemical analysis equipment can identify concentrations of hydrocarbons as a function of n and carbon to hydrogen (C/H) ratio with great specificity. The total carbon balance is given by Equation 37 and the total hydrogen balance is given by Equation 38:

$$\sum_{i=1}^{n} i * A_i + \sum_{i=1}^{n}\sum_{j=1}^{r} i * B_{i,j} = \sum_{i=1}^{n} i * E_i + \sum_{i=1}^{n}\sum_{j=1}^{r} i * F_{n,j} + \sum_{i=1}^{n} i * G_i + \sum_{i=1}^{n} i * I_i \tag{37}$$

$$\sum_{i=1}^{n} 2(i+) * A_i + \sum_{i=1}^{n}\sum_{j=1}^{r} 2(i+1-j) * B_{i,j} + 2D = \sum_{i=1}^{n} 2(i+1) * E_i + \sum_{i=1}^{n}\sum_{j=1}^{r} 2(i+1-j) * F_{n,j} + \sum_{i=1}^{n} 2i * G_i + \sum_{i=1}^{n} 2(i-1) * I_i + 2L \tag{38}$$

where the stochiometric coefficients for each of the hydrocarbon species (i.e., $A_n$, $B_{n,r}$, $E_n$, $F_{n,r}$, $G_n$ and $I_n$) come from Equation 30 previously and represent the total equation mass balance for each of the carbon species with n carbons.

The stochiometric coefficients for the hydrocarbon species ($A_n$, $B_{n,r}$, $E_n$, $F_{n,r}$, $G_n$ and $I_n$) appear in both the carbon mass balance and the hydrogen mass balance (which also includes coefficients D and L). The stochiometric coefficient D, J, and K are related based on the oxygen balance previously discussed in relation to Equations 35 and 36. The stochiometric coefficients are constrained by these equations, which becomes a solvable system of equations for coefficients of the reaction.

The final concentrations of species can also be known, where $[CO_2]$, $[O_2]$, $[H_2]$ can be measured directly. If not all water is consumed during the plasma-driven chemical reaction, the initial concentration of water can be calculated directly from the gaseous product concentration and the final concentration of water in the drilling fluid, given by Equation 39:

$$[H_2O]_{initial}=[H_2O]_{final}+2([CO_2]_{final}+[O_2]_{final}) \tag{39}$$

Where initial denotes the concentration in the formation fluid and drilling fluid downhole before the plasma reaction, and final denotes the concentrations measured in the drilling fluid after the reaction (either at the surface or with analysis equipment downhole). If the drilling fluid contains water when it is pumped downhole, the formation fluid's water concentration can then be given by Equation 40, which accounts for a change in water concentration due to formation fluid influx:

$$[H_2O]_{initial}=\Delta[H_2O]_{drilling\ fluid}+2([CO_2]_{final}+[O_2]_{final}) \tag{40}$$

where the change in drilling concentration in the drilling fluid is represented by A, which is the change in the water concentration measured in the drilling fluid before and after the reaction.

Product hydrocarbon concentrations $[C_nH_{2n+2}]$, $[C_nH_{2(n+1-r)}]$, $[C_nH_{2n}]$, and $[C_nH_{2n-2}]$can also be measured or determined and then used as "knowns" to further refine the various equations, particularly Equation 30. The known and unknowns together create a system of equations where the initial formation concentrations before the plasma reaction are solvable. Further, reaction kinetics allow refining of the concentrations based on known product concentration and calculable reaction rates. This can be combined with the first isotope ratio and the system of equations above, particularly Equations 28 and 29, to estimate the second isotope ratio. For example, the first isotope ratio can be determined or measured for each of the product species and then used to determine a second isotope ratio for the same product species. Each of these relationships can be used to determine an accurate second isotope ratio or to refine an earlier determination.

By determining or knowing reaction rates and the order of the rate limiting step, exact concentrations of reactants are calculable from product concentrations. For hydrocarbon hydrogenation, most reaction rates are first order or zeroth order. Zeroth order reactions depend only on time, not on reactant concentration (to a first approximation), and product concentrations follow Equation 41:

$$[Z]=k(T)*\Delta t \tag{41}$$

where [Z] is the product concentration; k(T) is the rate constant, and Δt is the time interval of the reaction.

These types of reaction kinetics correspond to chemical reactions dependent on free radicals, equilibrium rearrangement at high temperature (such as for hydrocarbon isomers in equilibrium), and for catalyzed reactions where k may be zeroth order with respect to reactants but depend on the concentration of a catalyst. For first order reactions, product concentrations are related to reactant concentrations by Equation 42:

$$[Z]=k(T)[A]*\Delta t \tag{42}$$

where [A] is the concentration of reactant molecule A. Where the concentration of A is also a function of time, the relationship is given by Equation 43:

$$[Z]=\int k(T)[A]dt \tag{43}$$

In general, the concentration of a first order reactant as a function of time is given by solving the rate equation to get Equation 44, below:

$$[A]=[A]_0e^{-k(T)*t} \tag{44}$$

where $[R]_0$ is the initial concentration of generic reactant R, k(T) is the reaction rate constant, and tis time. Substituting Equation 44 into Equation 43 yields Equation 45:

$$[Z]=\int k(T)[A]_0e^{-k(T)*t}dt=k(T)[A]_0\int e^{-k(T)*t}dt=[A]_0e^{-k(T)*t} \tag{45}$$

where this relationship holds when one molecule of reactant A yields one molecule of product Z. The product concentration for first order reactions can be similarly related to reactant concentrations for different stochiometric relationships as well.

Knowing the reactant concentrations with more certainty allows further refining of the system of equations. These constraints and equations can be combined with the first isotope ratio and the system of equations above, particularly Equations 28 and 29, to estimate the second isotope ratio.

At 508, the estimated second isotope ratio can be refined by correlating reaction rates to plasma energy. By applying reaction rate calculations, e.g., using the Arrhenius equations above, additional equations can be generated to better define a system of equations to determine a definite solution for the isotope ratio. Many of the reaction pathways can share transition states, where transition states determine the activation energy $E_a$ of a reaction pathway. For reactions with known activation energy $E_a$, the reaction rate constant k(T) can be calculated directly from the measured temperature at the plasma (based on the Arrhenius or similar equation) or can be estimated based on a plasma power analysis performed in the borehole previously. For example, with reference to FIG. 1, the computer system(s) 162 can perform operations to apply the reaction calculations using measured temperature and plasma power, to refine the estimated second isotope ratio. As noted above, plasma energy can be determined from plasma power.

By correlating reaction rate constant to temperature and plasma power, rate constant values can be further refined. The rate constant for a plasma reaction is a function of temperature, plasma power, and activation energy. Activation energy for transition states can be known or calculated. Determination of a reaction rate constant for a first order reaction can be made by varying the plasma power (where temperature is constant, and activation energy is a function of the transition state and therefore constant for the specific reaction mechanism) as shown in Equations 46-48:

$$[Z]_1 = k(T, P_1)[A]*\Delta t \tag{46}$$

$$[Z]_2 = k(T, P_2)[A]*\Delta t \tag{47}$$

$$\frac{[Z]_1}{[Z]_2} = \frac{k(T, P_1)}{k(T, P_2)} = f\left(\frac{P_1}{P_2}\right) \sim f(P) \tag{48}$$

where $P_1$ is the first plasma power, $P_2$ is the second plasma power, $[Z]_1$ is the product concentration at the first plasma power, $[Z]_2$ is the product concentration at the second plasma power; T is temperature, t represents time, and where the reactant concentration [A] is determined by the formation and does not vary over the time scale of the power analysis. The power analysis can be simplified if all time and temperatures remain constant while power is varied, so that the relationship between k(T) and power can be explored.

The dependence of the rate constant on plasma power can be determined from the product concentrations as a function of power. Once the relationship between rate constant k and plasma power is known, then the relationships between reactant concentration and product concentration can generate another set of equations that further restrict the degrees of freedom of the system. If the power variation is performed at the same depth in the borehole, further analysis and the system of equations allows the second isotope ratio can be known with increased certainty.

At 510, the estimated second isotope ratio can be refined by correlating reaction rates to the plasma type. The reaction rate constants can also vary by plasma type. For example, the reaction rate constants for plasma arcs can be different than the reaction rate constants for plasma sparks even for similar products and reactants over the same rate limiting step. Certain reaction products are favored by different types of plasma, as previously discussed in relation to hydroxyl free radical formation and hydroxyl-mediated versus photon mediated reaction pathways. Reaction rate constants for each type of plasma can be determined via a plasma power analysis or a spark versus arc ratio analysis.

The estimated second isotope ratio can be refined by updating the plasma energy and reaction rate estimates and calculations are updated based on a ratio of plasma arcs to plasma sparks, i.e. a plasma arc to plasma spark ratio or just "arc to spark ratio." The arc to spark ratio can be determined or calculated based on at least one of product concentrations from the downhole reaction, product species from the downhole reaction, a volume of the influent drilling fluid, and a volume of the effluent drilling fluid. In one or more embodiments, the first isotope ratio and the second isotope ratio can be related to the arc to spark ratio, and that relationship can be described by a model, e.g. a system of equations or created via an iterative process like machine learning or other artificial intelligence. For example, a ratio between the plasma power that generates the plasma arc (e.g., plasma arc 338) and the plasma power that generates any plasma sparks (e.g., plasma spark 337) can be determined, e.g., with reference to FIG. 1, via the computer system(s) 162. This ratio may be calculated as a fraction, a percentage, or a range. The ratio between the arc and spark for the plasma can also depend on or be based on the power used to generate the plasma and upon borehole geometry and dielectric characteristics. As discussed in reference to FIG. 3A-3C, both porosity and permeability along with formation fluid resistivity, can contribute both to the total dielectric strength between the anode and cathode and to the distribution of plasma arcing vs. sparking. Plasma arcs and plasma sparks can produce distinctive products and the ratio of these products can correspond to the ratio between the plasma arc and spark. For instance, plasma sparks generate high temperature, more spherical plasma and vapor bubbles in fluid, whereas plasma arcs generate lower temperature and more elongated bubbles with longer lifetimes. Certain species, for example, are preferentially formed in each type of plasma. For example, plasma sparks favor formation of hydroxyl catalyzed reaction and produce a significant amount of hydrogen, whereas plasma arcs favor photon catalyzed reactions, where ultraviolet (UV) photons especially promote carbon-carbon bond formation especially cyclic alkanes (naphthenes).

Within a plasma, particles can be so energetic that chemical bonds are in flux. The chemical composition of ions and molecules can be set when they leave the plasma, either because the plasma is quenched, or because their kinetic energy takes them outside of the plasma bounds. In either case, the chemical reactions can occur at the boundaries of the plasma where each species no longer experiences the excitation or collisions for it to reach a transitional state (as explained in reference to FIGS. 6A-6B above). The chemical reaction rates for formation of complex hydrocarbons from alkanes and naphthenes (as described in Equation 30) can depend most closely on the concentration of hydroxyl radicals and on energetic photons, both of which function as catalysts for such reactions.

The plasma arc can be approximated as a cylinder sustained by electrons from an anode (e.g., anode 328) to a cathode (e.g., cathode 329) and generate larger, elongated gas-phase bubbles. The plasma spark can represent the plasma generated that does not complete the circuit between the anode and the cathode and tends to generate spherical bubbles as a result of hydrodynamics.

Each type of plasma type also trends towards a different plasma temperature. Plasma arcs have lower electron temperatures than plasma sparks, where plasma sparks have higher electron kinetic energy because more energy is required to create a plasma in the absence of the strong electric field between the anode and cathode. The individual reactions occurring in each type of plasma can be the same, but the dominant reaction mechanisms can differ as a result of differences in surface area and temperature.

Further, plasma sparks dominantly affect $C^{12}$ more than $C^{13}$ because of the difference in bond energy between the two isotopes. This same is true for other isotopes. By knowing the type of reaction, i.e. predominantly arc or predominantly spark, the shift in chemical reaction can be modeled due to changes in bond energy. The models can be used in conjunction with systems of equations (as mentioned previously) and/or with machine learning to further refine the estimation of the second isotope ratio.

The plasma energy and reaction rate estimates and calculations can be updated based on the arc to spark ratio, e.g., via computer system(s) 162. The arc to spark ratio can be estimated and updated, along with the other reaction and plasma parameters, until the stochiometric equations balance and concentrations of formation fluid species are determined. The computer system(s) 162 can determine the reactant concentrations and/or isotope ratios exactly or to within a preselected error range. Such a determination can involve an iteration of all factors, multiple iterations, look up of reaction rate constants based on plasma power, or based on machine learning. The computer system(s) 162 can maintain a record of the drilling fluid species concentration and isotope ratios before and after the plasma is applied (i.e., a record of species concentration and isotope ratios the influent drilling fluid 130 and a record of species concentration and isotope ratios of the effluent drilling fluid 131) in order to correctly account for species in the drilling fluid, species in the formation fluid, and the species that are reactants in the plasma chemical reaction (measured as chemical products). This allows a refined determination of the second isotope ratio.

The relationship between the product and reactant concentrations can thereby be constrained enough to allow for solving for reactant concentrations based on measured product concentrations and plasma parameters. While the steps above are described in sequence, some or all of the steps can be performed in a different order or in parallel. Further, not all steps, e.g., steps to refine the answer may be required. For example, computing time and resources could be preserved by only performing some of the steps above to arrive at an acceptable value for the second isotope ratio. These solutions can be determined directly, with sufficient product information, or can be solved iteratively such as by machine learning applied to the body of data. For example, machine learning (e.g., linear regression, logistic regression, CART, Naïve Bayes, KNN, Apriori, K-means, principal component analysis, Bagging with Random Forest, Boosting with AdaBoost, etc.) or artificial intelligence (e.g., via one or more neural network) can be utilized to iteratively solve the one or more of the systems of equations above to determine the second isotope ratio from the first isotope ratio and the downhole reaction.

Referring again to FIG. 4, at 412, in one or more embodiment, the analysis system 160 correlates at least one of the first isotope ratio and the second isotope ratio to a depth (e.g., a depth and/or location within the borehole or a depth and/or location in the formation). A depth or location of the drill bit 123 within the borehole 110 can be tracked and transmitted to the analysis system 160 (e.g., to the computer system(s) 162) as the drill bit 123 penetrates formation 113 within the borehole 110. In one or more embodiment, the analysis system 160 can receive data (e.g., from an external source) and determine, e.g. via computer system(s) 162, the depth or location of the drill bit 123 within the borehole 110 based on the received data. The depth of the drill bit 123 within the borehole 110 can correspond to a depth or location within the borehole 110 where the effluent drilling fluid 131 was pumped through the drill bit 123 and circulated to the surface 103, e.g., to fluid reconditioning system 142 or extraction system 144.

In one or more embodiment, the analysis system 160 can determine the depth or location of the drill bit 123 within the borehole 110 at which effluent drilling fluid 131 is pumped to correlate or associate the depth with data points or a data stream representing either or both of the first isotope ratio and the second isotope ratio, based on other data of the system 100. For example, the analysis system 160 can receive other data that includes a volume of the annulus 114 of the borehole 110, a speed or velocity of influent drilling fluid 130 being pumped into the borehole 110, a time that influent drilling fluid 130 is pumped into the borehole 110, and a time that effluent drilling fluid 131 returns to a surface 103. The analysis system 160 can compare the volume of the annulus 114, the velocity of the influent drilling fluid 130 pumped into the borehole 110, the time that influent drilling fluid 130 is pumped into the borehole 110, and the time that effluent drilling fluid 131 returns to the surface of the borehole 110 to determine the location or depth of the drill bit 123 within the borehole 110.

The analysis system 160 then can determine the relationship between either, or both, of the first isotope ratio and the estimated and/or refined second isotope ratio and the depth within the borehole 110 correlated to the respective isotope ratios. As drilling progress, the analysis system 160 and/or the remote computer system 163 record an isotopic ratio data point for either or both of the first isotope ratio and the second isotope ratio correlated or associated with the depth of the drill bit 123 resulting an isotope ratio log for the various depths drilled. In or one or more embodiment, the analysis system 160 can execute operations for using various methods or techniques to determine the relationship between the various isotopic ratio data points and depths associated with the isotopic ratio data points. As an example, the analysis system 160 and/or the remote computer system 163 can determine the relationship between the various isotopic ratio data points and depths associated with the isotopic data points by applying a regression analysis to the various isotopic ratio data points and depths associated with the isotopic data points. Regression analysis may include determining a change in one or more of the isotopic ratio data points based on a change in the depth within the borehole 110. Based on the isotopic ratio data points, the depths, and the relationship between the two, the analysis system 160 can output data in various forms, including, for example, as a chart, a plot, a graph, etc. The output data can then be utilized for determining geological information about the borehole 110 and formation 113.

At 414, the computer system(s) 162 and/or the remote computer system 163 can be used to characterize reservoir fluids of a reservoir intersected by the borehole 110. For example, as discussed above, the output data or determined geological information based on the estimated and/or refined second isotope ratio can be used to determine the makeup of the formation fluid 315 in the formation 113 intersected by the borehole 110. This formation fluid 315 is, or correlates to, the fluid of the reservoir intersected by the borehole 110. Also, the estimated and/or refined second isotope ratio can be particularly helpful in determining the biogenicity and/or thermogenicity of the reservoir. Thus, the estimated and/or refined second isotope ratio, especially as logged per depth, can be used to characterize the reservoir. Further, the output data or determined geological information based on the estimated and/or refined second isotope ratio can be used to determine the history of the reservoir (e.g. changes, charges, degradation, connection to other reservoirs, etc.) and/or create a model of the reservoir (such a 3D reservoir model), especially when compared with data from neighboring boreholes and other geological information (e.g. other isotope logs, seismic logs, acoustic logs, well logs, production data, other drilling data, or the like).

The flowcharts in FIGS. 4 and 5 are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. For example, the operations depicted in FIG. 5 can be performed in parallel or concurrently. With respect to FIG. 4, block 414 is often performed but is additive to determining the second isotope ratio for each depth. It will be understood that each block of the flowchart illustrations and/or block diagrams, and combinations of blocks in the flowchart illustrations and/or block diagrams, can be implemented by program code. The program code may be provided to a processor of a general purpose computer, special purpose computer, or other programmable machine or apparatus.

As will be appreciated, aspects of the disclosure may be embodied as a system, method, or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine readable medium(s) may be utilized. The machine readable medium may be a machine readable signal medium or a machine readable storage medium. A machine readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine readable storage medium may be any tangible medium that can contain, or store a program for use by or in connection with an instruction execution system, apparatus, or device.

A machine readable storage medium is not a machine readable signal medium. A machine readable signal medium may include a propagated data signal with machine readable program code embodied therein, for example, in baseband or as part of a carrier wave. Such a propagated signal may take any of a variety of forms, including, but not limited to, electro-magnetic, optical, or any suitable combination thereof. A machine readable signal medium may be any machine readable medium that is not a machine readable storage medium and that can communicate, propagate, or transport a program for use by or in connection with an instruction execution system, apparatus, or device.

Program code embodied on a machine readable medium may be transmitted using any appropriate medium, including but not limited to wireless, wireline, optical fiber cable, RF, etc., or any suitable combination of the foregoing.

The program code/instructions may also be stored in a machine readable medium that can direct a machine to function in a particular manner, such that the instructions stored in the machine readable medium produce an article of manufacture including instructions which implement the function/act specified in the flowchart and/or block diagram block or blocks.

Figure 7:
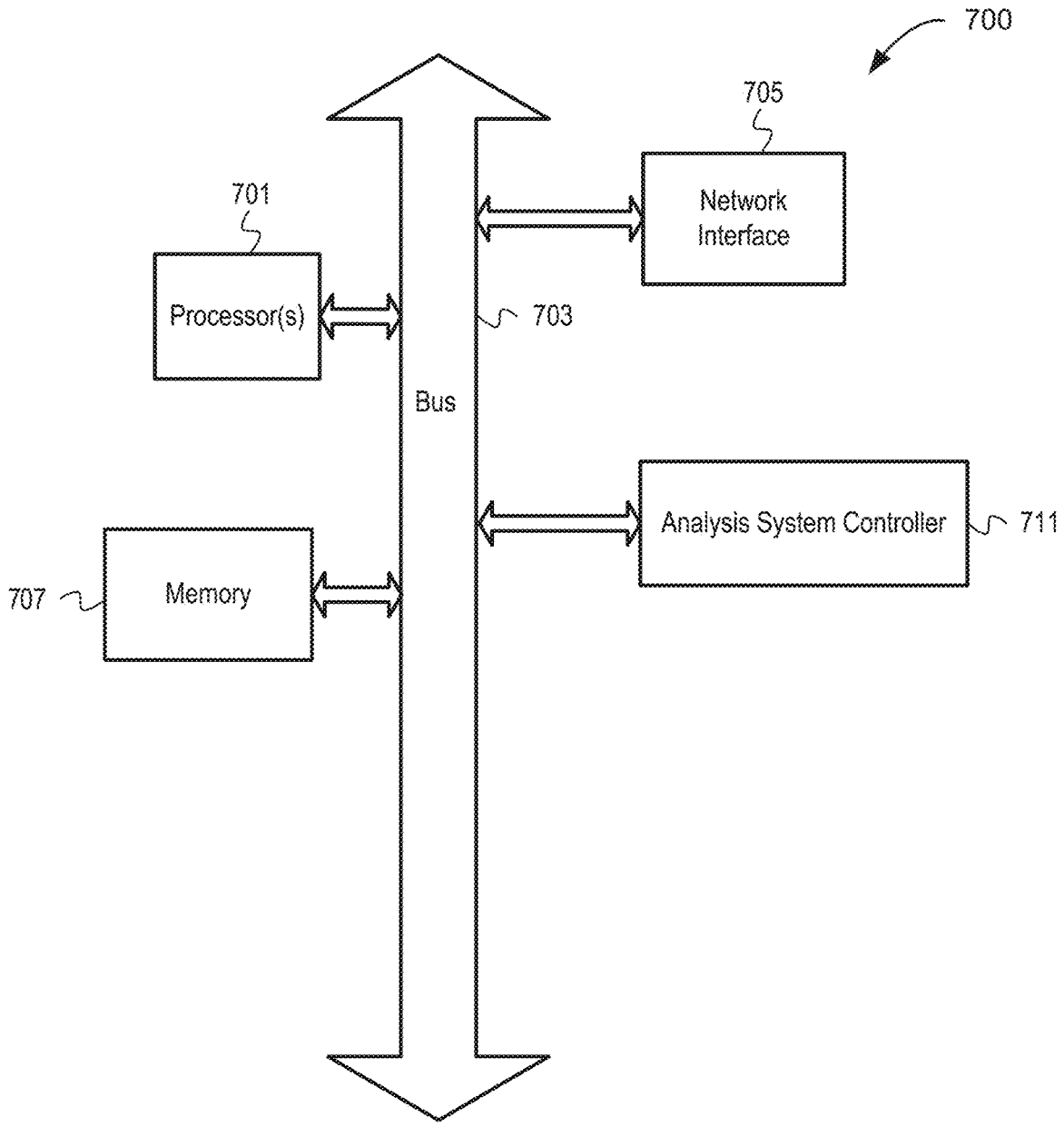
FIG. 7 depicts an example computer system, according to one or more embodiment.

FIG. 7 depicts an example computer system 700, according to one or more embodiments. The computer system 700 includes one or more processors 701 (possibly including multiple processors, multiple cores, multiple nodes, and/or implementing multi-threading, etc.). The one or more processors 701 can execute instructions stored on one or more machine-readable medium. The stored instructions can cause the processor to implement any methods describe above. The computer system 700 includes memory 707. The memory 707 may be system memory or any one or more of the above already described possible realizations of machine-readable medium. The computer system 700 also includes a bus 703 and a network interface 705. The computer system 700 also includes an analysis controller 711. The analysis controller 711 can direct the analysis of the instrumentation (such as instrumentation 161) and receive measurements, calculations, and determinations from the instrumentation. Further, the analysis controller 711 can make calculations or determination based on the measurements, calculations, and determinations of the instrumentation. Any one of the previously described functionalities may be partially (or entirely) implemented in hardware and/or on the one or more processors 701. For example, the functionality may be implemented with an application specific integrated circuit, in logic implemented in the processor 701, in a co-processor on a peripheral device or card, etc. Further, realizations may include fewer or additional components not illustrated in FIG. 7 (e.g., video cards, audio cards, additional network interfaces, peripheral devices, etc.). The one or more processors 701 and the network interface 705 are coupled to the bus 703. Although illustrated as being coupled to the bus 703, the memory 707 may be coupled to the one or more processors 701. Computer system(s) 162 and/or remote computer system 163 can include the components and/or functionality of computer system 700. For example, the remote computer system 163 can include the same components as computer system 700, but may be located remove from the drill site, e.g., in communication with the computer system(s) 162 via communication link 164. In one or more embodiment, computer system(s) 162 can access machine readable medium having instructions stored thereon that are executable by one or more processors (such as the one or more processors 701) to cause the one or more processors to determine a first isotope ratio of effluent drilling fluid 131, wherein the effluent drilling fluid 131 is the drilling fluid after the drilling fluid has interacted with a plasma discharge produced via the one or more electrodes; estimate a second isotope ratio based on the first isotope ratio and a downhole reaction generated by the plasma discharge proximate to the one or more electrodes; and, optionally, to correlate at least one of the first isotope ratio and the second isotope ratio to a depth within the borehole 110.

While the aspects of the disclosure are described with reference to various implementations and exploitations, it will be understood that these aspects are illustrative and that the scope of the claims is not limited to them. In general, techniques for estimating isotope ratios while pulsed power drilling, as described herein may be implemented with facilities consistent with any hardware system or hardware systems. Many variations, modifications, additions, and improvements are possible.

Plural instances may be provided for components, operations, or structures described herein as a single instance. Finally, boundaries between various components, operations, and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Example Embodiments

Numerous examples are provided herein to enhance understanding of the present disclosure. A specific set of example embodiments are provided as follows:

Example A: A method comprising determining a first isotope ratio of an effluent drilling fluid, wherein the effluent drilling fluid is a drilling fluid after the drilling fluid has interacted with a plasma discharge produced via one or more electrodes of a drill bit of a pulsed power drill string disposed in a borehole; and estimating a second isotope ratio based on the first isotope ratio and a downhole reaction generated by the plasma discharge.

The method in Example A can further comprise one or more of the following (in any order): (1) correlating at least one of the first isotope ratio and the second isotope ratio to a depth within the borehole; (2) characterizing reservoir fluids of a reservoir intersected by the borehole based on the second isotope ratio; (3) determining a third isotope ratio of an influent drilling fluid, wherein the influent drilling fluid is the drilling fluid before the drilling fluid has interacted with the plasma discharge, and updating the estimate of the second isotope ratio based on the third isotope ratio, and, optionally, obtaining a sample of the influent drilling fluid by at least one of extracting or sampling gas from the influent drilling fluid with a gas extraction system and sampling a liquids from the influent drilling fluid, and determining a concentration or amount of two respective isotopes of a same element in the sample; (4) obtaining a sample of the effluent drilling fluid by at least one of extracting or sampling gas from the effluent drilling fluid with a gas extraction system and sampling a liquids from the effluent drilling fluid, and determining a concentration or amount of two respective isotopes of a same element in the sample; (5) disposing the pulsed power drill string into the borehole, the pulsed power drill string comprising the drill bit having the one or more electrodes, circulating the drilling fluid within a flow path that extends into and out of the borehole, the borehole disposed in a subsurface formation, and producing, via the one or more electrodes, the plasma discharge through the subsurface formation to generate the downhole reaction, and, optionally, wherein power is electrically discharged from the one or more electrodes into the subsurface formation and the drilling fluid, and/or further comprising determining one or more properties of the subsurface formation based on second isotope ratio; (6) determining a first composition of the effluent drilling fluid, determining a second composition based on the first composition, and determining one or more properties of a subsurface formation based on the second composition and the second isotope ratio, and, optionally, determining a third composition of an influent drilling fluid, wherein the influent drilling fluid is the drilling fluid before the drilling fluid has interacted with the plasma discharge, and determining the second composition based on the first composition, the downhole reaction, and the third composition.

In one or more embodiments of Example A, estimating the second isotope ratio based on the first isotope ratio and the downhole reaction comprises determining a plasma energy; determining a difference in chemical composition between the effluent drilling fluid and an influent drilling fluid, wherein the influent drilling fluid is the drilling fluid before the drilling fluid has interacted with the plasma discharge; estimating the second isotope ratio based on a concentration of species in the drilling fluid, the first isotope ratio, and stoichiometry of the downhole reaction; refining the second isotope ratio by correlating one or more reaction rates of the downhole reaction to the plasma energy, and, optionally, at least one of (1) refining the second isotope ratio by correlating the one or more reaction rates to a plasma type, wherein correlating the one or more reaction rates to the plasma type can comprise determining a plasma arc to plasma spark ratio based on at least one of a power used to generate the plasma, product concentrations from the downhole reaction, product species from the downhole reaction, a volume of the influent drilling fluid, and a volume of the effluent drilling fluid; and (2) measuring a temperature of the downhole reaction and measuring a pressure of the downhole reaction, wherein the one or more reaction rates are correlated to the plasma energy based on the temperature and the pressure.

Example B: A system comprising a pulsed power drill string disposed in a borehole, the pulsed power drill string comprising a drill bit having one or more electrodes; drilling fluid circulating within a flow path extending into and out of the borehole; one or more processors; and a machine-readable medium having instructions stored thereon that are executable by the one or more processors to cause the one or more processors to determine a first isotope ratio of an effluent drilling fluid, wherein the effluent drilling fluid is the drilling fluid after the drilling fluid has interacted with a plasma discharge produced via the one or more electrodes; and estimate a second isotope ratio based on the first isotope ratio and a downhole reaction generated by the plasma discharge.

In one or more embodiments of Example B the machine-readable medium has further instructions stored thereon that are executable by the one or more processors to cause the one or more processors to correlate at least one of the first isotope ratio and the second isotope ratio to a depth within the borehole. In one or more embodiments of Example B estimating the second isotope ratio based on the first isotope ratio and the downhole reaction can comprise determining a plasma energy; determining a difference in chemical composition between the effluent drilling fluid and an influent drilling fluid, wherein the influent drilling fluid is the drilling fluid before the drilling fluid has interacted with the plasma discharge; estimating the second isotope ratio based on a concentration of species in the drilling fluid, the first isotope ratio, and stoichiometry of the downhole reaction; refining the second isotope ratio by correlating reaction rates of the downhole reaction to the plasma energy; and, optionally, refining the second isotope ratio by correlating the reaction rates to a plasma type, wherein correlating the reaction rate to the plasma type comprises determining a plasma arc to plasma spark ratio based on at least one of a power used to generate the plasma, product concentrations from the downhole reaction, product species from the downhole reaction, a volume of the influent drilling fluid, and a volume of the effluent drilling fluid.

Example C: A machine readable medium having instructions stored thereon that are executable by a computing device to perform operations comprising determine a first isotope ratio of an effluent drilling fluid, wherein the effluent drilling fluid is a drilling fluid after the drilling fluid has interacted with a plasma discharge produced via one or more electrodes, where the one or more electrodes are components of a drill bit of a pulsed power drill string disposed in a borehole; and estimating a second isotope ratio based on the first isotope ratio and a downhole reaction generated by the plasma discharge.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

The invention claimed is:

1. A method comprising:

determining a first isotope ratio of an effluent drilling fluid, wherein the effluent drilling fluid is a drilling fluid after the drilling fluid has interacted with a plasma discharge produced via one or more electrodes of a drill bit of a pulsed power drill string disposed in a borehole; and estimating a second isotope ratio based on the first isotope ratio and a downhole reaction generated by the plasma discharge, wherein estimating the second isotope ratio based on the first isotope ratio and the downhole reaction, comprises:

determining a plasma energy;

determining a difference in chemical composition between the effluent drilling fluid and an influent drilling fluid, wherein the influent drilling fluid is the drilling fluid before the drilling fluid has interacted with the plasma discharge;

estimating the second isotope ratio based on a concentration of species in the drilling fluid, the first isotope ratio, and stoichiometry of the downhole reaction; and refining the second isotope ratio by correlating one or more reaction rates of the downhole reaction to the plasma energy.

2. The method of claim 1, further comprising correlating at least one of the first isotope ratio and the second isotope ratio to a depth within the borehole.

3. The method of claim 1, further comprising characterizing reservoir fluids of a reservoir intersected by the borehole based on the second isotope ratio.

4. The method of claim 1, wherein determining the second isotope ratio based on the first isotope ratio and the downhole reaction further comprises refining the second isotope ratio by correlating the one or more reaction rates to a plasma type.

5. The method claim 4, wherein correlating the one or more reaction rates to the plasma type comprises determining a plasma arc to plasma spark ratio based on at least one of a power used to generate the plasma, product concentrations from the downhole reaction, product species from the downhole reaction, a volume of the influent drilling fluid, and a volume of the effluent drilling fluid.

6. The method of claim 1, further comprising:

measuring a temperature of the downhole reaction; and measuring a pressure of the downhole reaction, wherein the one or more reaction rates are correlated to the plasma energy based on the temperature and the pressure.

7. The method of claim 1, further comprising:

determining a third isotope ratio of an influent drilling fluid, wherein the influent drilling fluid is the drilling fluid before the drilling fluid has interacted with the plasma discharge; and updating the estimate of the second isotope ratio based on the third isotope ratio.

8. The method of claim 7, wherein determining the third isotope ratio comprises:

obtaining a sample of the influent drilling fluid by at least one of:

extracting or sampling gas from the influent drilling fluid with a gas extraction system, and sampling a liquid from the influent drilling fluid; and determining a concentration or amount of two respective isotopes of a same element in the sample.

9. The method of claim 1, wherein determining the first isotope ratio comprises:

obtaining a sample of the effluent drilling fluid by at least one of:

extracting of sampling gas from the effluent drilling fluid with a gas extraction system, and sampling a liquid from the effluent drilling fluid; and determining a concentration or amount of two respective isotopes of a same element in the sample.

10. The method of claim 1, further comprising:

disposing the pulsed power drill string into the borehole, the pulsed power drill string comprising the drill bit having the one or more electrodes;

circulating the drilling fluid within a flow path that extends into and out of the borehole, the borehole disposed in a subsurface formation; and producing, via the one or more electrodes, the plasma discharge through the subsurface formation to generate the downhole reaction.

11. The method of claim 10, wherein power is electrically discharged from the one or more electrodes into the subsurface formation and the drilling fluid.

12. The method of claim 10, further comprising determining one or more properties of the subsurface formation based on second isotope ratio.

13. The method of claim 1, further comprising:

determining a first composition of the effluent drilling fluid;

determining a second composition based on the first composition; and determining one or more properties of a subsurface formation based on the second composition and the second isotope ratio.

14. The method of claim 13, further comprising:

determining a third composition of an influent drilling fluid, wherein the influent drilling fluid is the drilling fluid before the drilling fluid has interacted with the plasma discharge; and determining the second composition based on the first composition, the downhole reaction, and the third composition.

15. A system comprising:

a pulsed power drill string disposed in a borehole, the pulsed power drill string comprising a drill bit having one or more electrodes;

drilling fluid circulating within a flow path extending into and out of the borehole;

one or more processors; and a machine-readable medium having instructions stored thereon that are executable by the one or more processors to cause the one or more processors to determine a first isotope ratio of an effluent drilling fluid, wherein the effluent drilling fluid is the drilling fluid after the drilling fluid has interacted with a plasma discharge produced via the one or more electrodes; and estimate a second isotope ratio based on the first isotope ratio and a downhole reaction generated by plasma discharge, wherein estimating the second isotope ratio based on the first isotope ratio and the downhole reaction comprises:

determining a plasma energy;

determining a difference in chemical composition between the effluent drilling fluid and an influent drilling fluid, wherein the influent drilling fluid is the drilling fluid before the drilling fluid has interacted with the plasma discharge;

estimating the second isotope ratio based on a concentration of species in the drilling fluid, the first isotope ratio, and stoichiometry of the downhole reaction; and refining the second isotope ratio by correlating reaction rates of the downhole reaction to the plasma energy.

16. The system of claim 15, wherein the machine-readable medium has further instructions stored thereon that are executable by the one or more processors to cause the one or more processors to:

correlate at least one of the first isotope ratio and the second isotope ratio to a depth within the borehole.

17. The system of claim 15, wherein estimating the second isotope ratio based on the first isotope ratio and the downhole reaction further comprises:

refining the second isotope ratio by correlating the reaction rates to a plasma type, wherein correlating the reaction rate to the plasma type comprises determining a plasma arc to plasma spark ratio based on at least one of a power used to generate the plasma, product concentrations from the downhole reaction, product species from the downhole reaction, a volume of the influent drilling fluid, and a volume of the effluent drilling fluid.

18. A non-transitory machine readable medium having instructions stored thereon that are executable by a computing device to perform operations comprising:

determine a first isotope ratio of an effluent drilling fluid, wherein the effluent drilling fluid is a drilling fluid after the drilling fluid has interacted with a plasma discharge produced via one or more electrodes, where the one or more electrodes are components of a drill bit of a pulsed power drill string disposed in a borehole; and estimating a second isotope ratio based on the first isotope ratio and a downhole reaction generated by the plasma discharge, wherein estimating the second isotope ratio based on the first isotope ratio and the downhole reaction comprises:

determining a plasma energy;

determining a difference in chemical composition between the effluent drilling fluid and an influent drilling fluid, wherein the influent drilling fluid is the drilling fluid before the drilling fluid has interacted with the plasma discharge;

estimating the second isotope ratio based on a concentration of species in the drilling fluid, the first isotope ratio, and stoichiometry of the downhole reaction; and refining the second isotope ratio by correlating reaction rates of the downhole reaction to the plasma energy.

* * * * *